US010577754B2

(12) United States Patent
Grobinski et al.

(10) Patent No.: US 10,577,754 B2
(45) Date of Patent: Mar. 3, 2020

(54) MODULAR SKATE COMPONENT AND SYSTEMS THEREOF

(71) Applicant: Krypton Design LLC, Wilkes-Barre, PA (US)

(72) Inventors: Michael Christopher Grobinski, Kingston, PA (US); Daniel Slade Lykens, Kingston, PA (US)

(73) Assignee: KRYPTON DESIGN LLC, Wilkes-Barre, PA (US)

( * ) Notice: Subject to any disclaimer, the term of this patent is extended or adjusted under 35 U.S.C. 154(b) by 0 days.

(21) Appl. No.: 15/855,192

(22) Filed: Dec. 27, 2017

(65) Prior Publication Data

US 2018/0179710 A1 Jun. 28, 2018

Related U.S. Application Data

(60) Provisional application No. 62/439,530, filed on Dec. 28, 2016.

(51) Int. Cl.

| | |
|---|---|
| ***E01C 13/00*** | (2006.01) |
| ***A63B 69/00*** | (2006.01) |
| ***A63C 19/00*** | (2006.01) |
| ***A63C 19/06*** | (2006.01) |
| ***A63C 19/10*** | (2006.01) |
| ***E01C 13/12*** | (2006.01) |
| ***B63B 35/73*** | (2006.01) |

(52) U.S. Cl.

CPC ..... *E01C 13/003* (2013.01); *A63B 69/0022* (2013.01); *A63C 19/00* (2013.01); *A63C 19/06* (2013.01); *A63C 19/10* (2013.01); *A63B 2225/60* (2013.01); *A63B 2225/605* (2013.01); *A63B 2244/18* (2013.01); *A63B 2244/186* (2013.01); *A63B 2244/19* (2013.01); *B63B 35/73* (2013.01); *E01C 13/12* (2013.01)

(58) Field of Classification Search

CPC ... E01C 13/003; E01C 13/12; A63B 69/0022; A63B 2244/186; A63B 2244/18

See application file for complete search history.

(56) References Cited

U.S. PATENT DOCUMENTS

| | | | | |
|---|---|---|---|---|
| 5,524,310 | A * | 6/1996 | Farnen | A63C 19/10 14/69.5 |
| 5,946,756 | A | 9/1999 | Mapp | |
| 6,223,673 | B1 * | 5/2001 | Mears | A63B 5/11 114/264 |
| 7,114,210 | B2 * | 10/2006 | Heinz | B66F 7/243 14/69.5 |
| 2003/0119590 | A1 * | 6/2003 | Pernal | A63C 19/10 472/88 |

(Continued)

OTHER PUBLICATIONS

Dallas News, Hydrous Wake Park, 2012, https://www.dallasnews.com/life/life/2012/07/01/check-out-hydrous-wake-park-the-water-park-that-is-making-a-big-splash-in-allen (Year: 2012).*

*Primary Examiner* — Michael D Dennis

(74) *Attorney, Agent, or Firm* — The Belles Group, P.C.

(57) ABSTRACT

Described herein is a modular skate system that includes at least one modular skate component comprising a major surface, a core comprising a body formed from a first material, an outer layer formed from a second material, the outer layer surrounding at least a portion of the core, wherein the first material is different from the second material, and wherein the major surface comprises the outer layer.

16 Claims, 24 Drawing Sheets

(56) References Cited

U.S. PATENT DOCUMENTS

| | | | | |
|---|---|---|---|---|
| 2003/0125120 | A1 | 7/2003 | Montolio | |
| 2009/0255066 | A1* | 10/2009 | Brock | A63C 19/10 14/69.5 |

* cited by examiner

MODULAR SKATE COMPONENT AND SYSTEMS THEREOF

CROSS-REFERENCE TO RELATED APPLICATIONS

This application claims the benefit of U.S. Provisional Application No. 62/439,530, filed on Dec. 28, 2016. The disclosure of the above application is incorporated herein by reference.

BACKGROUND

Skate parks are large constructed areas with ramps, grind-rails and the like that are used typically by skateboarders, bicyclists and in-line skaters. These structures are fairly expensive to build and maintain, as well as take extensive time and supervision for installation. Accordingly, there exists a need for a new type of skate park that overcomes these deficiencies.

BRIEF SUMMARY

The present invention includes embodiments that include a modular skate component comprising a major surface, a core comprising a body formed from a first material, an outer layer formed from a second material, the outer layer surrounding at least a portion of the core, wherein the first material is different from the second material, and wherein the major surface comprises the outer layer.

According to other embodiments, the present invention includes a modular skate system comprising a first modular skate component comprising a first body, a first major surface, and a first side surface that intersects the first major surface, the first side surface comprising a first attachment component, a second modular skate component comprising a second body, a second major surface, and a second side surface that intersects the second major surface, the second side surface comprising a second attachment component, a third attachment component configured to cooperate with both the first attachment component and the second attachment component, wherein the first modular skate component is coupled to the second modular skate component by the cooperation between the third attachment component and the first and second attachment components, and wherein the first body is separated by the second body by at least a layer.

Other embodiments of the present invention include a skate component attachment apparatus comprising a first foam body, a first polymeric layer, a second polymeric layer, a second foam body, and an attachment component comprising an attachment body that extends along a longitudinal axis between a first end and a second end, wherein the first end of the attachment component is surrounded by the first foam body, the second end of the attachment component is surrounded by the second foam body, and at least a portion of the attachment body extends through both the first polymeric layer and the second polymeric layer.

Other embodiments of the present invention include a method of installing modular skate park comprising providing a first modular skate component having a first side surface that comprises a first attachment component, a second modular skate component having a second side surface comprising a second attachment component, and a third attachment component, slidingly engaging the third attachment component with each of the first attachment component and the second attachment component, and bringing together the first modular skate component and the second modular skate component such that the first side surface abuts the second side surface.

In other embodiments, the present invention is directed to a method of forming a modular skate component comprising providing a shaped body having an outer surface, the shaped body formed from a first material, coating the outer surface of the shaped body with a second material to form a continuous layer that at least partially surrounds the shaped body, thereby forming an encapsulated structure.

In other embodiments, the present invention is directed to a sport ramp apparatus comprising a foam body; and a polymeric layer surrounding the foam body, wherein the sport ramp comprises a major surface, side surfaces, and a bottom surface, whereby the major surface has a first thickness and the side and bottom surfaces have a second thickness, the first thickness being greater than the second thickness, and the sport ramp apparatus has an overall density that is less than 63 $lb/ft^3$.

Other embodiments of the present invention include a method of forming a modular skate ramp comprising: a) providing a shaped body of a first polymeric material, the foam body having an outer surface comprising an upper surface opposite a lower surface and a first side surface opposite a second side surface, the first and second side surfaces intersecting the lower surface; b) inserting a cutting device into the foam body such that a portion of the cutting device is present in the foam body between the upper surface and the lower surface; c) moving the cutting device relative to the foam body to form a cut-out a portion of the first polymeric material and removing the cut-out portion to form and a cavity in the foam body; d) coating the outer surface of the foam body with a second polymeric material to form a skin that surrounds the outer surface of the foam body.

Other embodiments of the present invention include a modular skate component comprising: an outer surface comprising a major surface, a lower surface, a first side surface, and a second side surface, the major surface opposite the lower surface and the first side surface opposite the second side surface, and the first and second side surfaces intersecting the major surface; a foam core formed from a first polymeric material; an outer layer formed from a second polymeric material, the second polymeric material being different from the first polymeric material, and wherein the outer layer at least partially surrounds the core such that the major surface, lower surface, the first side surface, and the second side surface comprises the outer layer.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
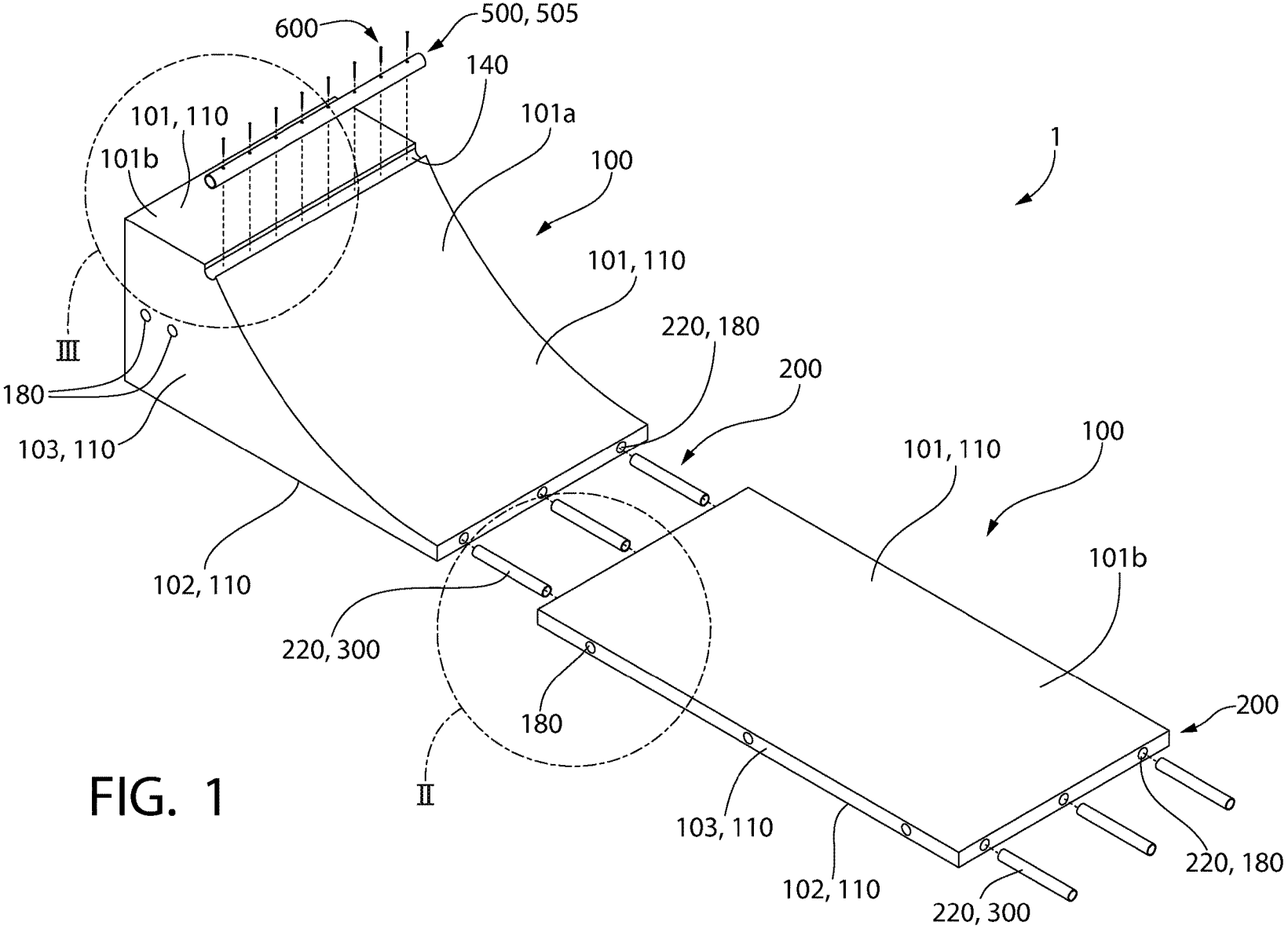
FIG. 1 a modular skate system according to the present invention.

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such.

Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Unless otherwise specified, all percentages and amounts expressed herein and elsewhere in the specification should be understood to refer to percentages by weight. The amounts given are based on the active weight of the material. According to the present application, the term "about" means +/−5% of the reference value. According to the present application, the term "substantially free" less than about 0.1 wt. % based on the total of the referenced value.

Figure 2:
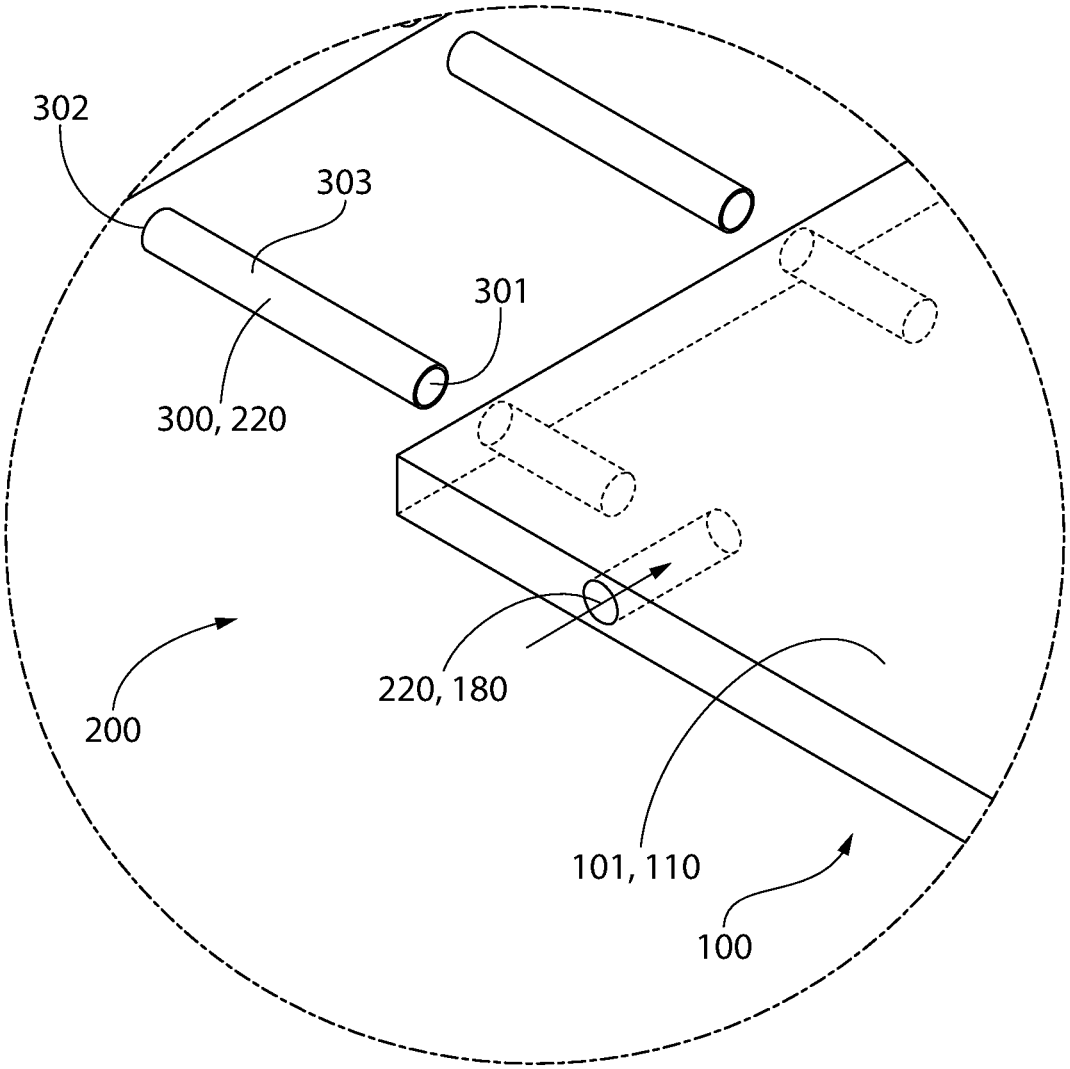
FIG. 2 is a close-up view of section II of FIG. 1.

Referring now to FIGS. 1 and 2, the present invention includes a modular sport system 1 suitable for recreational and competitive activities. In a non-limiting embodiment, the modular sport system 1 comprises a modular sport ramp 100 that is suitable in the formation of a skateboard park (also referred to as "skate park"), water-sport course, and/or a snow-sport course. As described in greater detail herein, the term "water-sport course" may refer to a course suitable for wakeboarding, jet-skiing, inner-tubing, and the like. As described in greater detail herein, the term "snow-sport course" may refer to a course suitable for snowboarding, skiing, inner-tubing, and the like. As discussed herein, the modular sport system 1 will be referred to as a modular skate system 1 and a modular skate ramp 100 (also referred to as a "modular skate component"), but the following discussion is not limited to such skateboard applications.

The skate system 1 suitable in the assembly of a modular skate park. The modular skate system 1 comprises a plurality of modular skate components 100 and at least one connection system 200 for connecting together at least two of the plurality of modular skate components 100. The present invention as described herein may be discussed as being suitable for skateboards. It should be noted, however, that the modular skate system 1 of the present invention may also suitable for other wheeled devices, such as rollerblades, scooters, and the like.

Each of the modular skate components 100 may comprise a plurality of external surfaces 110. The external surfaces 110 of each modular skate component may comprise at least one major surface 101, a lower surface 102, and a side surface 103 that may extend between the major surface 101 and the lower surface 102. The external surfaces 110 may further comprise a top support surface 104. According to the present invention, the term "major surface" 101 refers to the surface of the modular skate component 100 predominately exposed to contact with a skateboard during use. Of course, a skateboard may contact any external surface 110 of the modular skate component 100. Each of the modular skate components 100 may comprise one major surface 101. In other embodiments, the modular skate component 100 may comprise a plurality of major surfaces 101*a*, 101*b*—as discussed further herein.

Figure 7:
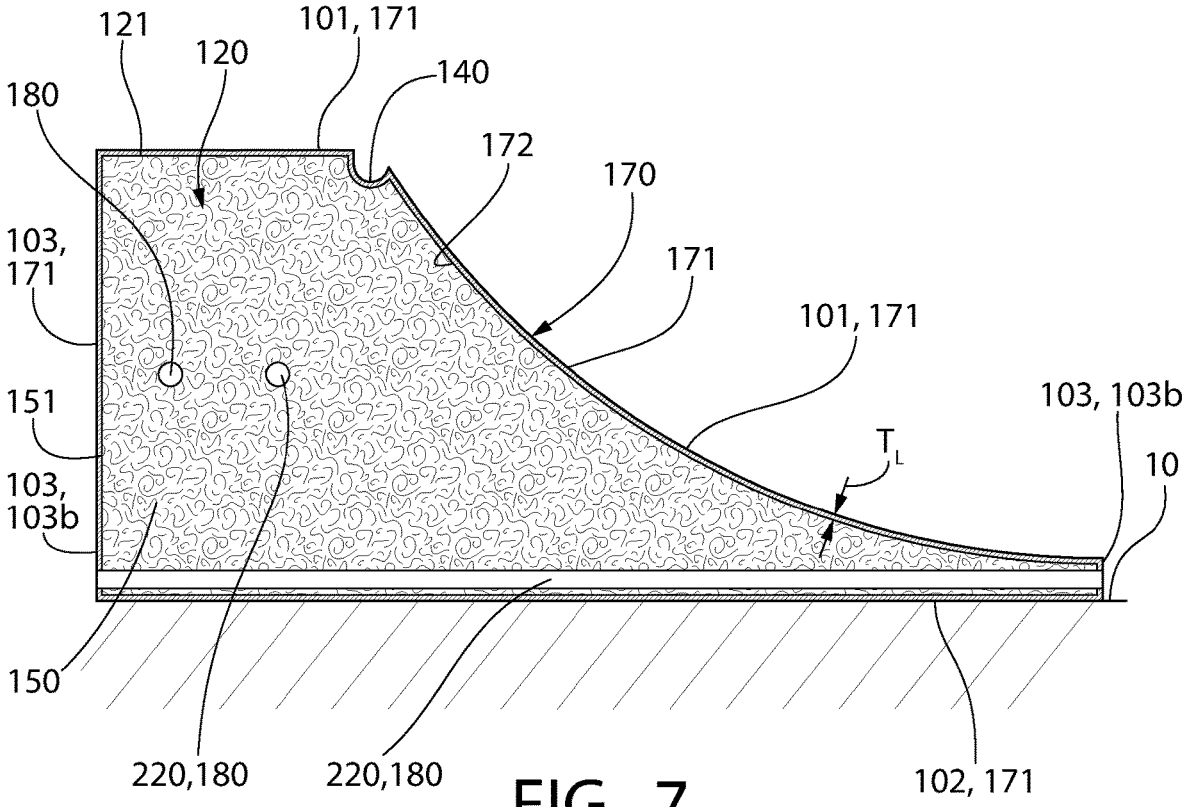
FIG. 7 is a cross-sectional view of the modular skate device atop a surface according lines VII-VII in FIG. 4.
Figure 8:
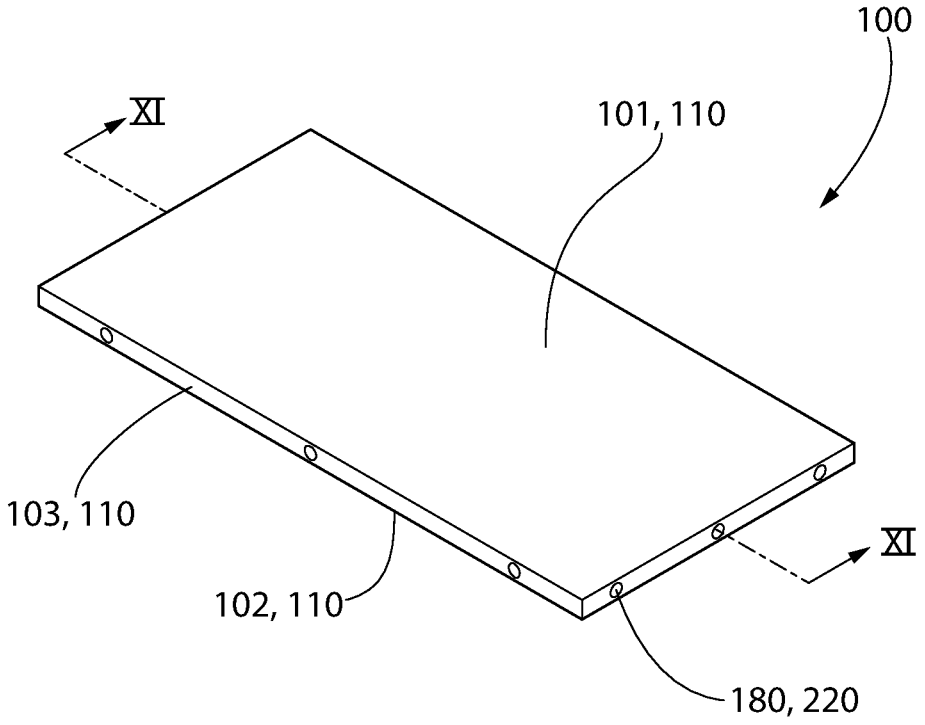
FIG. 8 is a top perspective view of a modular skate device according to another embodiment of the present invention.
Figure 9:
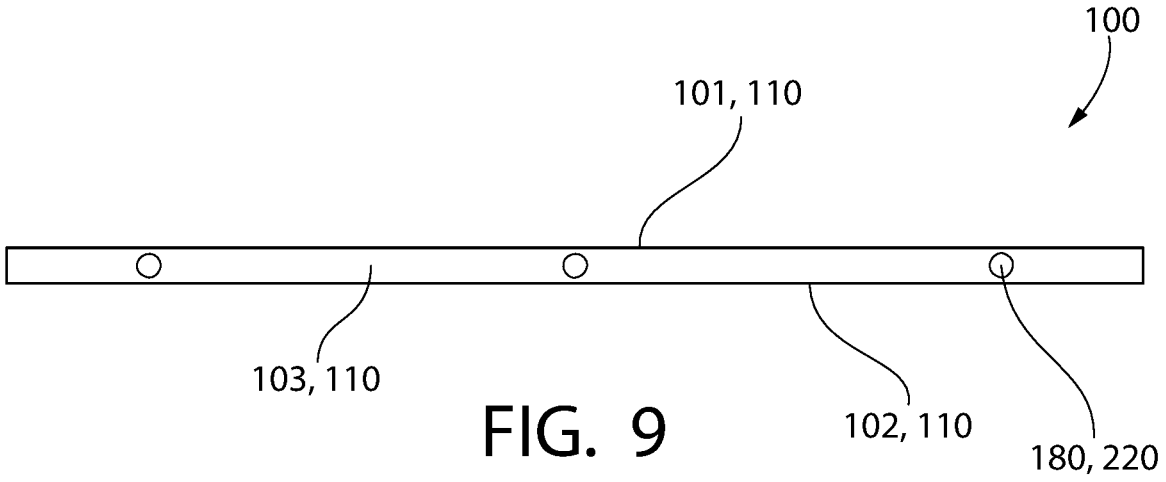
FIG. 9 is a side view of the modular skate device according FIG. 8.
Figure 10:
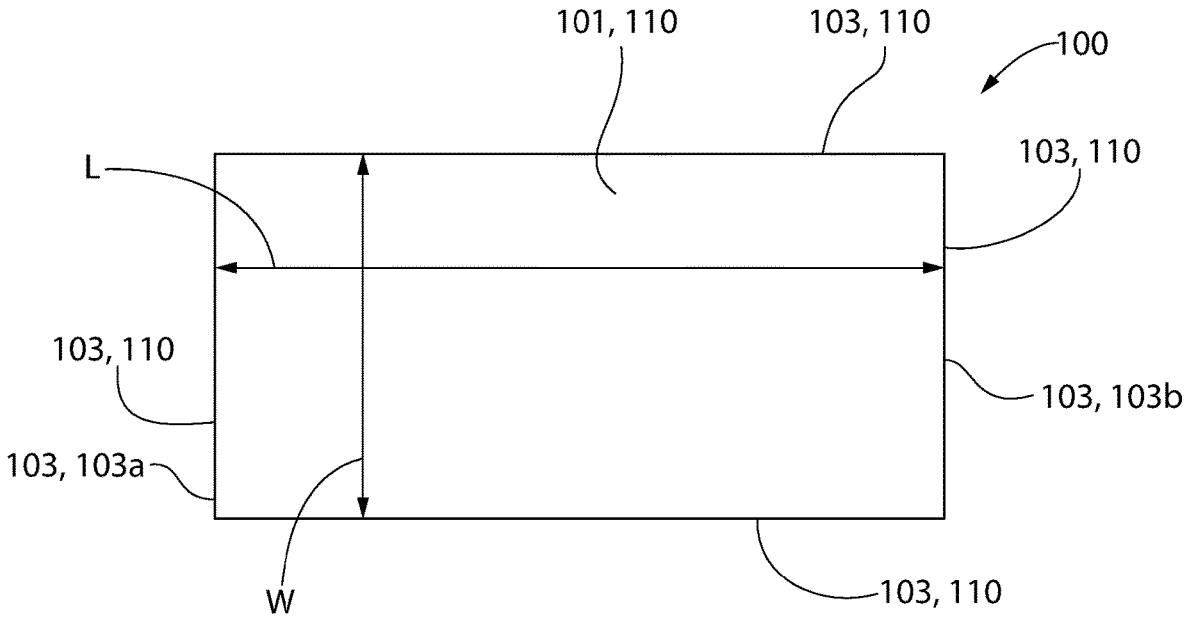
FIG. 10 is a top view of the modular skate device according FIG. 8.
Figure 11:
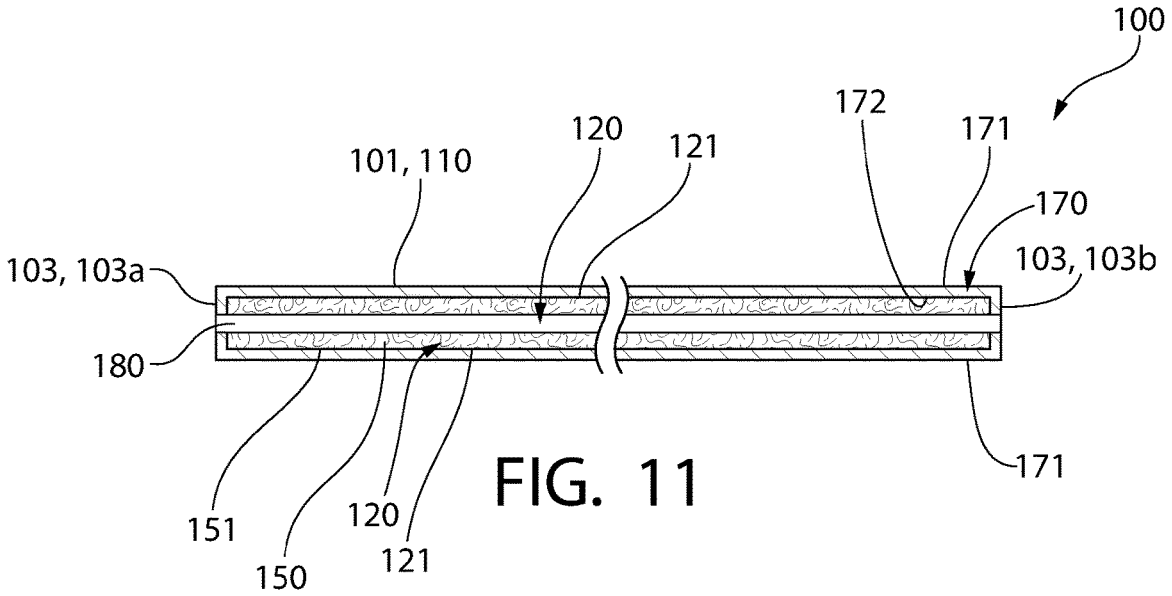
FIG. 11 is a cross-sectional view of the modular skate device atop a surface according lines IX-IX in FIG. 8.

The term "lower surface" 102 refers to a surface of the modular skate component 100 that may contact and be supported by a support surface 10 in the modular skate system 1 (see FIG. 7). The term "support surface" 10 refers to either (1) an external ground support or (2) the top support surface 104 of another modular skate component 100 (see FIG. 13). Non-limiting examples of an external ground support include a gymnasium floor, a concrete slab, asphalt top—such as in a parking lot, a dirt field, and the like.

The term "side surface" 103 refers to a surface that intersects with at least one of the major surfaces 101 of the modular skate component 100. The side surface 103 of the present invention may generally extend in a direction that is substantially normal to the lower surface 102. In other embodiments, the side surface 103 may extend in a direction that is oblique to the lower surface 102.

Figure 13:
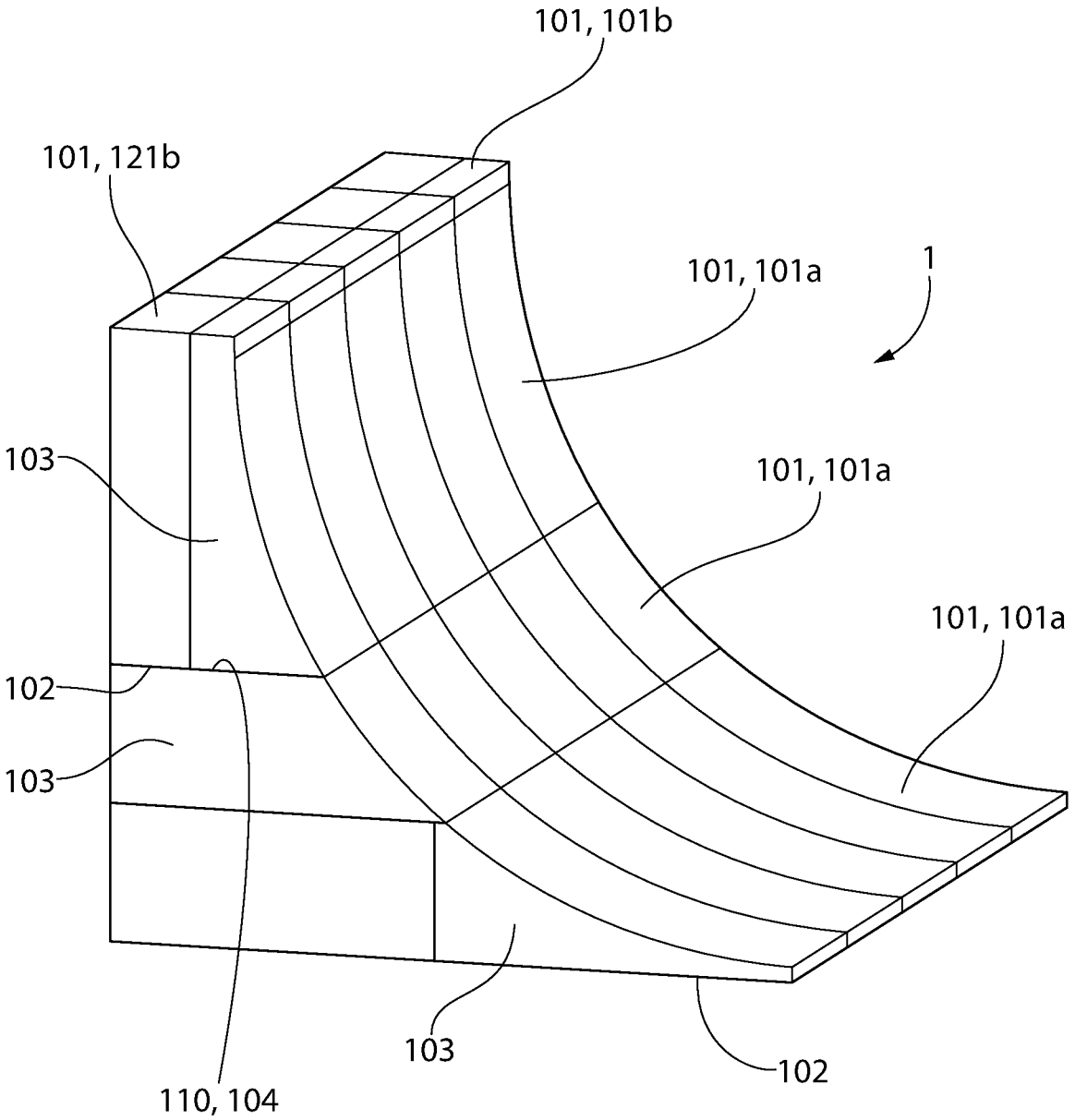
FIG. 13 a modular skate system according to another embodiment of the present invention.
Figure 14:
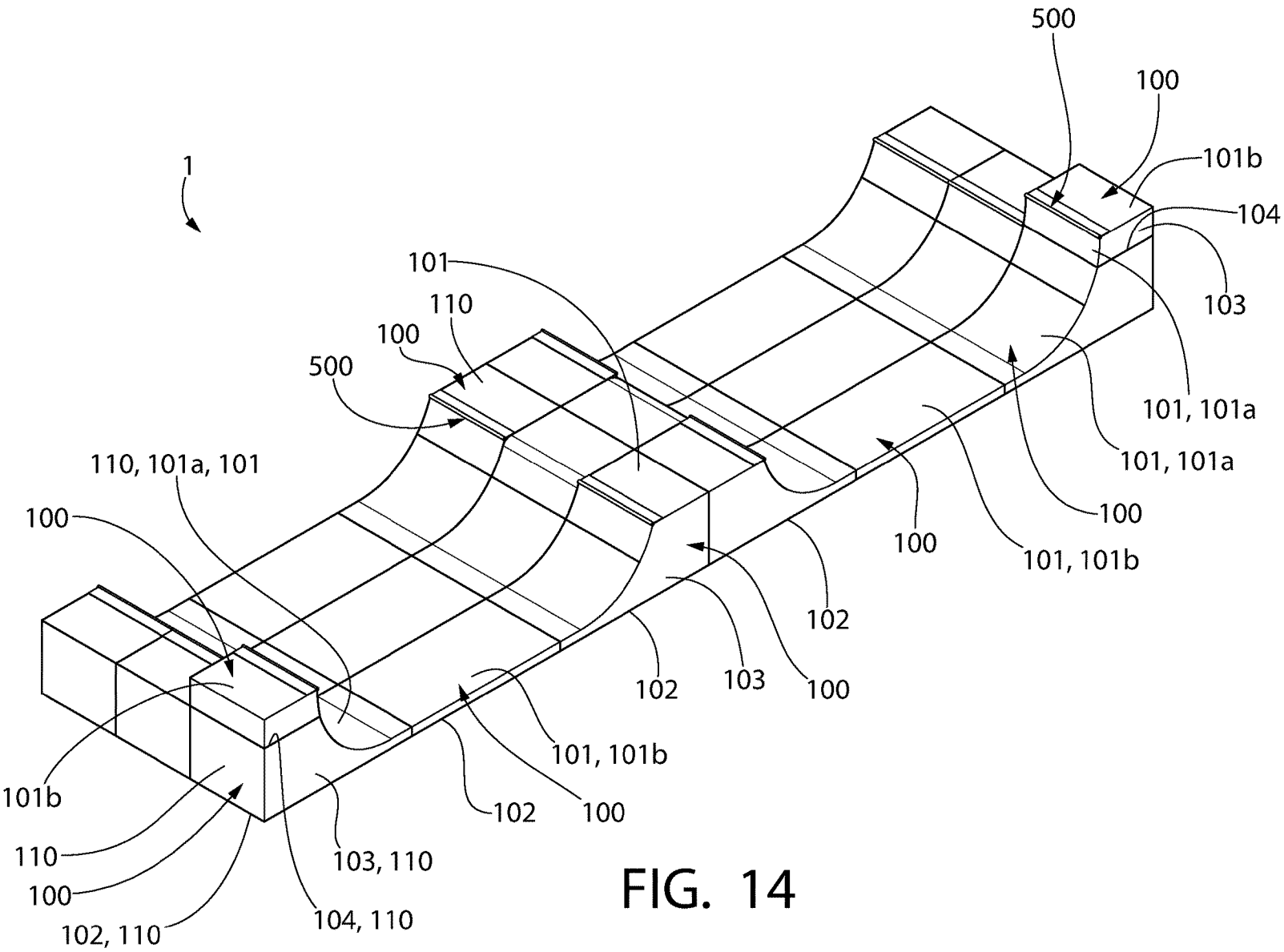
FIG. 14 a modular skate system according to another embodiment of the present invention.
Figure 15:
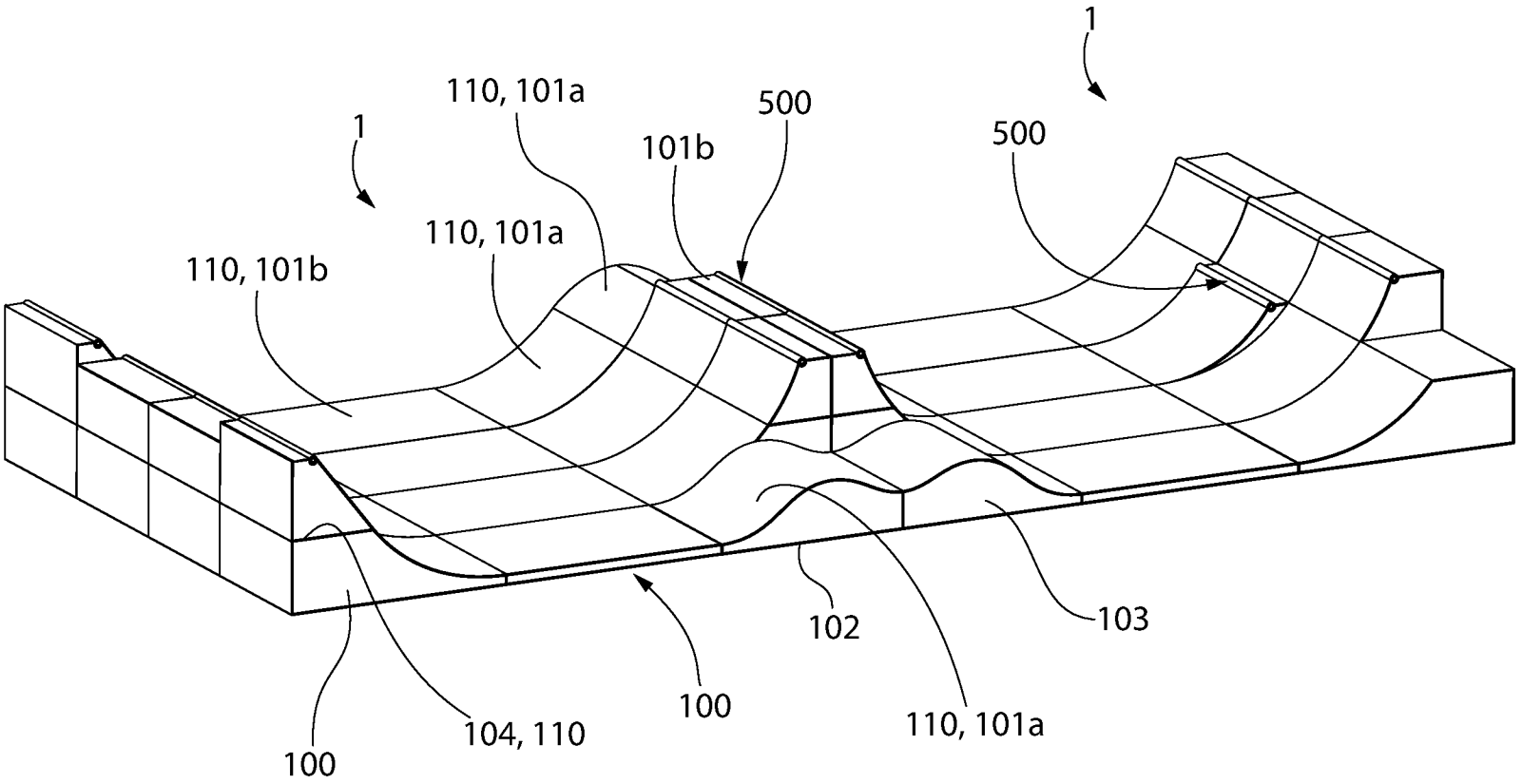
FIG. 15 a modular skate system according to another embodiment of the present invention.
Figure 16:
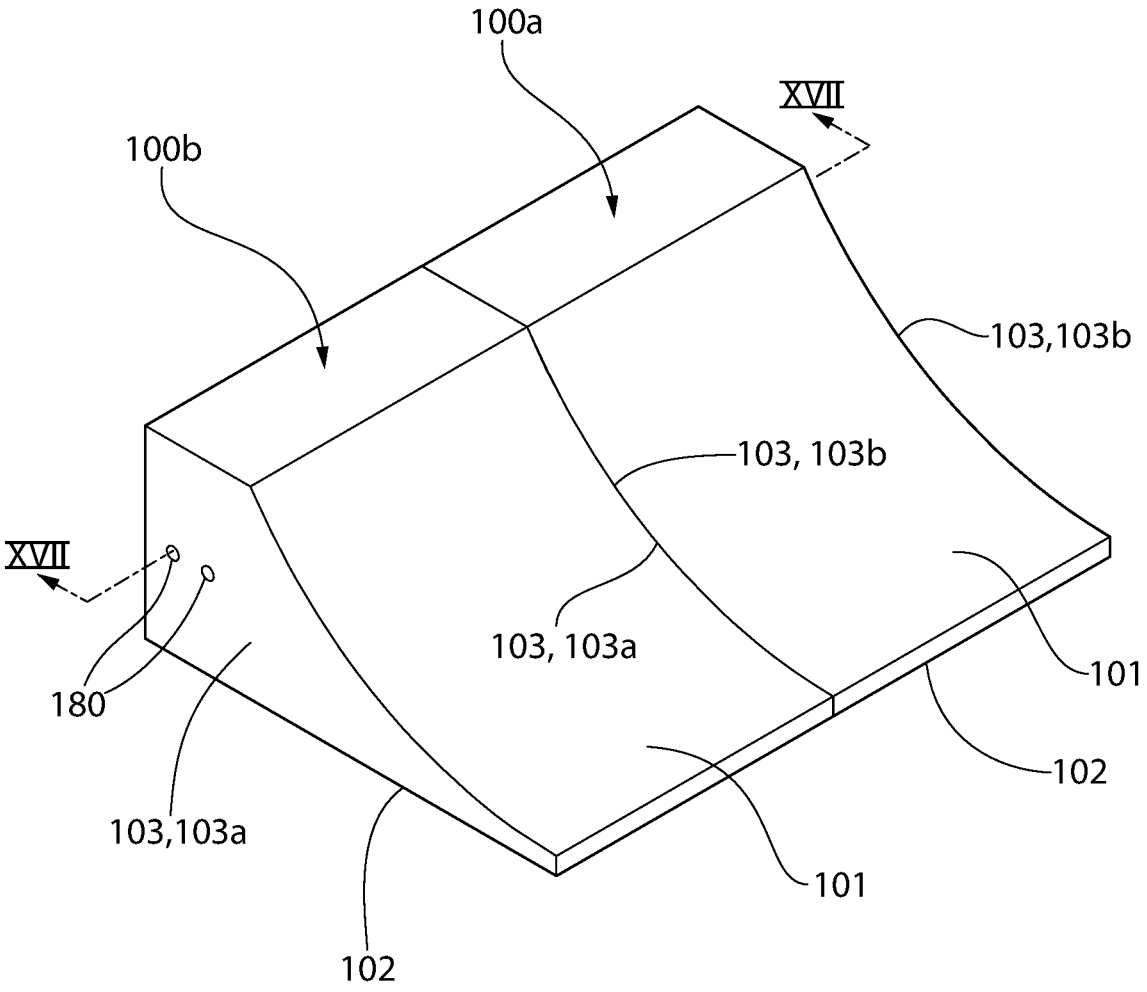
FIG. 16 is a modular skate system according to another embodiment of the present invention.

As demonstrated by FIG. 13, due to the geometry of large quarter-pipes and half-pipes that may be installed in the modular skate park, some embodiments of the present invention provide that the major surface 101 of the modular skate component 100 may be oriented almost if not entirely perpendicular to the lower surface 102—as discussed further herein.

Figure 5:
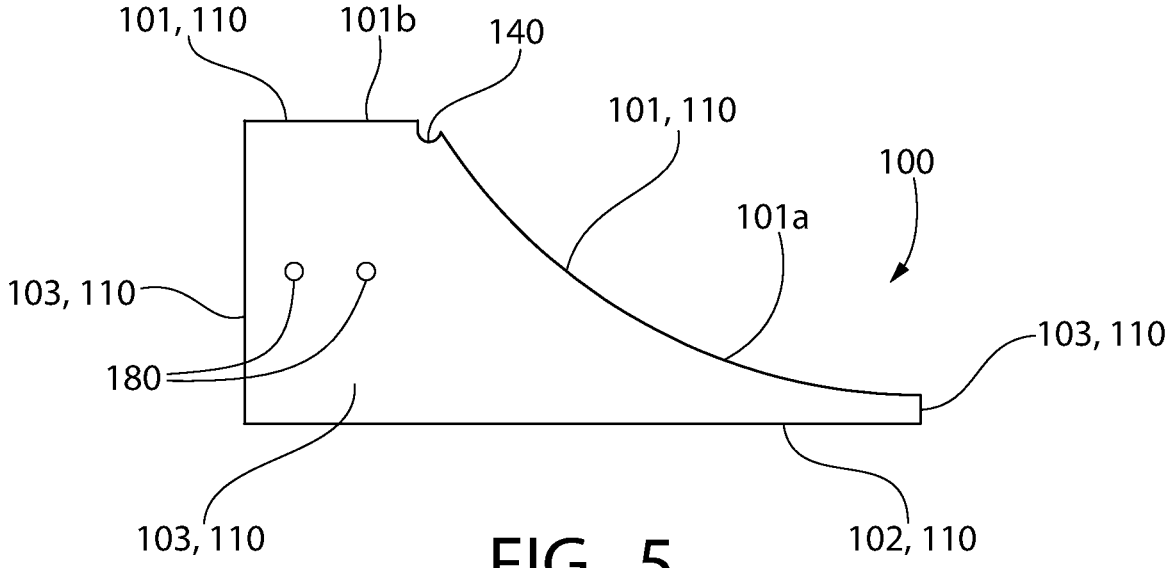
FIG. 5 is a side view of the modular skate device according FIG. 4.
Figure 6:
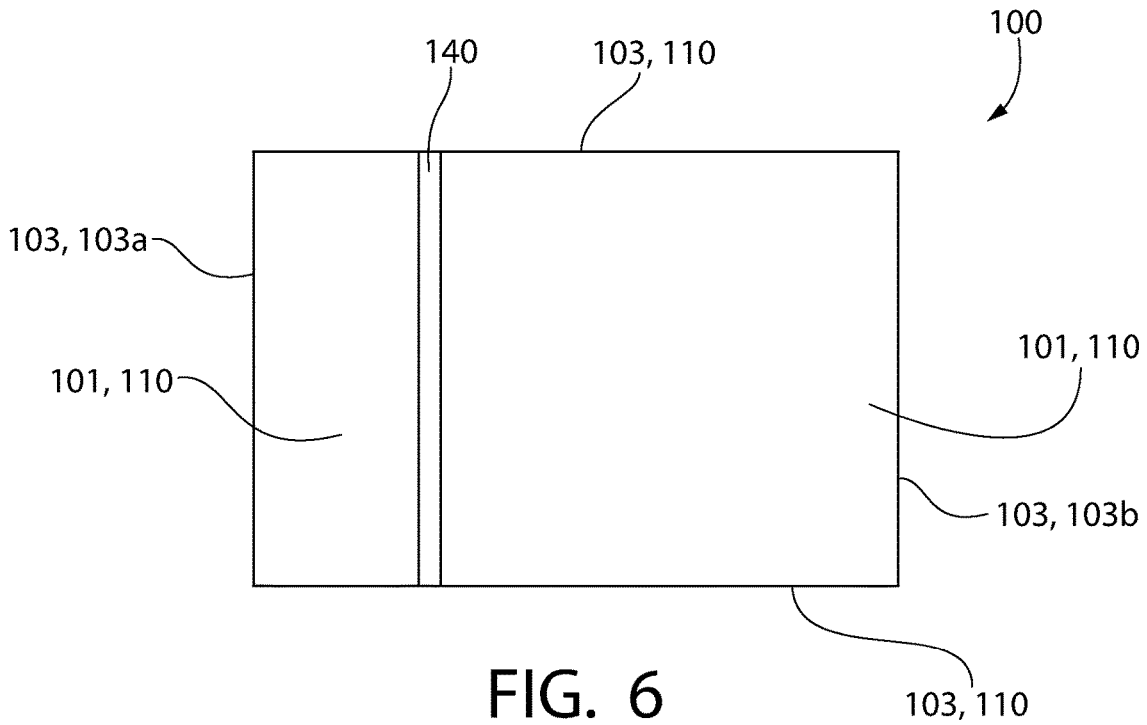
FIG. 6 is a top view of the modular skate device according FIG. 4.

The major surface 101 may be substantially planar—i.e., substantially flat as demonstrated by the major surface 101*b* in FIGS. 1, 5, and 13. In such embodiments, the term "substantially flat" refers to the major surface allowing for slight imperfections and variations in the topography due to material and/or manufacturing defects, but otherwise being planar.

In other embodiments, the major surface may be curved, as demonstrated by the major surface 101*a* in FIGS. 1, 5, and 13. The entirety of the major surface 101*a* may be curved. Alternatively, a portion of the major surface 101*a* may be planar with the remaining portion of the major surface 101*a* being curved. In such embodiments, although a portion of the cured major surface 101*a* comprises a planar portion, such major surface 101*a* will still be considered curved for the purpose of the present invention.

The major surface 101, 101*a*, 101*b* may be oriented oblique to the side surface 103 of the modular skate component 100. The major surface 101, 101*a*, 101*b* may be oriented oblique to the lower surface 102 of the modular skate component 100. In other embodiments, the major surface 101, 101*a*, 101*b* may be oriented substantially perpendicular to the side surface 103 of the modular skate component 100. According to such embodiments, the major surface 101, 101*a*, 101*b* may be oriented substantially parallel to the lower surface 102 of the modular skate component 100.

Referring now to FIG. 7, each of modular skate components 100 may be formed from a multi-component structure. The multi-component structure may comprise a core 120 and an outer layer 170. The outer layer 170 may at least partially surround the core 120—as described further herein. In other embodiments, the outer layer 170 may fully surround the core 120, thereby encapsulating the core 120. Although not shown, the modular skate component 100 may further comprise one or more intermediate layers positioned between the outer layer 170 and the core 120.

The core 120 may comprise an outer surface 121. The core 120 may be formed by a body 150 that extends between the outer surfaces 121 of the core 120. The body 150 may also comprise an outer surface 151. In some embodiments, the outer surface 121 of the core 120 may comprise the outer surface 151 of the body 150. In other embodiments, the core 120 may comprise one or more additional layers that surround the body 120. In such embodiments, the additional layers may form the outer surface 121 of the core 120.

The body 150 may extend continuously throughout the core 150. In other embodiments, the body 150 may extend discontinuously throughout the core 150, whereby one or more cavities are present in the core 120 by the space not occupied by the body 150 (not pictured).

The body 120 may be formed from a first material. The first material may be foam. The foam may be open-celled or close-celled. The foam may be a polymeric foam. The polymeric foam may comprise an organic polymer, an inorganic polymer, or a combination thereof. Non-limiting examples of the first material include foams formed from the following polymers: polystyrene, urethane polymers, polyvinyl chloride, copolymers of acrylo nitrile butadiene, copolymers of styrene butadiene, copolymers of ethylene-propylene-diene, polychloroprene, polyethylene, polypropylene, co-polymers of ethylene, co-polymers of propylene and combinations thereof. In a preferred embodiment, the first material comprises a foam formed from polystyrene.

The first material may have a first density that is a bulk density. Bulk density is measured as the overall total volume occupied by the body 150 within the outer surfaces 151 of the body 150. Thus, for a body 150 formed from foamed polymer, the bulk density includes the volume occupied by both the first material (i.e., foamed polymer) as well as the voids created by the cellular structure of the foamed polymer. The first density may range from about 0.8 $lb/ft^3$ to about 3 $lb/ft^3$—including all densities and sub-ranges there-between. In some embodiments, the first density may range from about 0.9 $lb/ft^3$ to about 2.5 $lb/ft^3$—including all densities and sub-ranges there-between. The first density may be about 2 $lb/ft^3$. Alternatively, the first density may be about 1 $lb/ft^3$.

Referring again to FIG. 7, the outer layer 170 may comprise a top surface 171 opposite a bottom surface 172. The outer layer 170 may have a layer thickness $T_L$ as measured by the distance between the top surface 171 and the bottom surface 172 of the outer layer 170. The layer thickness $T_L$ may range from about 50 mils to about 300 mils—including all thicknesses and sub-ranges there-between.

The layer thickness $T_L$ may be substantially uniform throughout the outer layer 170. In other embodiments, the layer thickness $T_L$ may vary depending on which portion of the outer layer 170 coincides with the major surface 101, side surface 103, and/or the lower surface 102. Specifically, the layer thickness $T_L$ of the major surface 101 may range from greater than about 125 mils to about 300 mils— preferably about 175 mils to about 250 mils—including all thicknesses and sub-ranges there-between. The layer thickness $T_L$ of the side surface 103, lower surface 102, and/or top support surface 104 may range from about 75 mils to less than about 275 mils—preferably about 130 mils to about 200 mils—including all thicknesses and sub-ranges there-between.

According to the present invention, there may be a ratio of the layer thickness $T_L$ for the major surface 101 to the layer thickness $T_L$ for the lower surface 102 may range from about 10.0:1.0 to about 1.1:1—including all ratios and sub-ranges there-between. In a preferred embodiment, the ratio of the layer thickness $T_L$ for the major surface 101 to the layer thickness $T_L$ for the lower surface 102 may range from about 3.0:1.0 to about 1.1:1—including all ratios and sub-ranges there-between.

According to the present invention, there may be a ratio of the layer thickness $T_L$ for the major surface 101 to the layer thickness $T_L$ for the side surface 103 may range from about 10.0:1.0 to about 1.1:1—including all ratios and sub-ranges there-between. In a preferred embodiment, the ratio of the layer thickness $T_L$ for the major surface 101 to the layer thickness $T_L$ for the side surface 103 may range from about 3.0:1.0 to about 1.1:1—including all ratios and sub-ranges there-between.

According to the embodiments directed to skate board applications, the modular skate component 100 may have a major surface 101 with a layer thickness $T_L$ that ranges from about 160 mils to about 220 mils—including all thickness and sub-ranges there-between. According to a preferred embodiment where the modular skate component is directed to skate board applications, the modular skate component 100 may have a major surface 101 with a layer thickness $T_L$ that ranges from about 170 mils to about 210 mils—including all thickness and sub-ranges there-between.

According to the embodiments directed to skate board applications, the modular skate component 100 may have a lower surface 102 with a layer thickness $T_L$ that ranges from about 100 mils to about 165 mils—including all thickness and sub-ranges there-between. According to a preferred embodiment where the modular skate component 100 is directed to skate board applications, the modular skate component 100 may have a lower surface 102 with a layer thickness $T_L$ that ranges from about 115 mils to about 150 mils—including all thickness and sub-ranges there-between. The layer thickness $T_L$ of the lower surface 102 may be less than the layer thickness $T_L$ of the major surface 101.

According to the embodiments directed to skate board applications, the modular skate component 100 may have a side surface 103 with a layer thickness $T_L$ that ranges from about 100 mils to about 165 mils—including all thickness and sub-ranges there-between. According to a preferred embodiment where the modular skate component 100 is directed to skate board applications, the modular skate component 100 may have a side surface 103 with a layer thickness $T_L$ that ranges from about 115 mils to about 150 mils—including all thickness and sub-ranges there-between. The layer thickness $T_L$ of the side surface 103 may be less than the layer thickness $T_L$ of the major surface 101.

According to the embodiments directed to skate board applications, the modular skate component 100 may have a ratio of the layer thickness $T_L$ for the major surface 101 to the layer thickness $T_L$ of the lower surface 102 that ranges from about 4.0:1 to about 1.1:1—including all ratios and sub-ranges there-between. In a preferred embodiment directed to skate board applications, the modular skate component 100 may have a ratio of the layer thickness $T_L$ for the major surface 101 to the layer thickness $T_L$ of the lower surface 102 that ranges from about 2:1 to about 1.1:1—including all ratios and sub-ranges there-between.

According to the embodiments directed to skate board applications, the modular skate component 100 may have a ratio of the layer thickness $T_L$ of the major surface 101 and the layer thickness $T_L$ of the side surface 103 that ranges from about 4.0:1 to about 1.1:1—including all ratios and sub-ranges there-between. In a preferred embodiment directed to skate board applications, the modular skate component 100 may have a ratio of the layer thickness $T_L$ of the major surface 101 and the layer thickness $T_L$ of the side surface 103 that ranges from about 2:1 to about 1.1:1—including all ratios and sub-ranges there-between.

The outer layer 170 may be formed from a second material. The second material may be different from the first material. For the purpose of this invention, the term "different material" refers to a material having a different chemical composition and/or different material properties (e.g., hardness, density, etc.).

The second material may be polymer. The polymer may be an organic polymer or an inorganic polymer, or a blend thereof. The second material may form a continuous polymeric barrier that is impervious to water between the top surface 171 and the bottom surface 172. The second material may exhibit both elastomeric properties as well as high-impact resistance. The second material may form a polymeric skin that allows the outer layer 170 to be the impervious water barrier. The second material may be sound-deadening.

Non-limiting examples of the second material include polyurethane. In a preferred embodiment, the second material comprises polyurethane. The polyurethane may be formed from a reactive composition comprising (A) isocyanate-functional monomer or prepolymer and (B) isocyanate-reactive compounds, such as polyol, polyamine, or mixtures thereof. The second material may further comprise one or more pigments.

The second material may have a second density that is a bulk density. The second density may range from about 45 $lb/ft^3$ to about 57 $lb/ft^3$—including all densities and sub-ranges there-between. In a preferred embodiment, the second density may range from about 48 $lb/ft^3$ to about 53 $lb/ft^3$—including all densities and sub-ranges there-between. Preferably, the second density may be about 52 $lb/ft^3$.

The first density may be different than the second density. The second density may be greater than the first density. The ratio of the second density to the first density may range from about 18:1 to about 80:1—including all ratios and sub-ranges there-between. The ratio of the second density to the first density may range from about 18:1 to about 60:1—including all ratios and sub-ranges there-between. In a preferred embodiment, the ratio of the second density to the first density may range from about 26:1 to about 52:1—including all ratios and sub-ranges there-between.

The second material may have a hardness ranging from about 50 to about 60 on the Shore D hardness scale—including all ratios and sub-ranges there-between. In a preferred embodiment, the hardness of the second material may range from about 53 to about 57 on the Shore D hardness scale—including all ratios and sub-ranges there-between. The first hardness may be different than the second hardness.

The overall modular skate component 100 may occupy a first volume $V_1$ as defined by the space occupied between the external surfaces 110 of the modular skate component 100. The core 120 may occupy a second volume $V_2$ as defined by the space within the outer surfaces 121 of the core 120. The layer 170 may occupy a third volume $V_3$ as defined by the total three-dimensional space occupied between the top surface 171 and bottom surface 172 of the layer 170. According to the present invention, the first volume $V_1$ may be substantially equal to the summation of the second volume $V_2$ and the third volume $V_3$—i.e., $$V_1=V_2+V_3$$

In other embodiments, the summation of the second volume $V_2$ and the third volume $V_3$ may be less than the first volume $V_1$ if one or more additional layers or components are present in the modular skate component 100—as discussed further herein.

The third volume $V_3$ may equal about 0.1% to about 15.0% of the first volume $V_1$—including all percentages and sub-ranges there-between. The second volume $V_2$ may equal about 85.0% to about 99.5% of the first volume $V_1$—including all percentages and sub-ranges there-between. The ratio of the second volume $V_2$ to the third volume $V_3$ may range from about 5:1 to about 200:1—including all ratios and sub-ranges there-between.

The second volume $V_2$ relative to each of the first volume $V_1$ and the third volume $V_3$ may vary depending on the shape of the modular skate component. In a non-limiting example, a modular skate component 100 having a flat platform shape (such as modular skate component 101*b* of FIG. 1) may have a third volume $V_3$ that is about 5% to about 15% of the first volume $V_1$—preferably about 9% to about 12% of the first volume $V_1$. In such non-limiting example, the modular skate component 100 may have a second volume $V_2$ that is about 85% to about 95% of the first volume $V_1$—preferably about 87% to about 91% of the first volume $V_1$. In such non-limiting example, the ratio of the second volume $V_2$ to the third volume $V_3$ would range from about 5:1 to about 20:1—including all ratios and sub-ranges there-between. In such non-limiting example, the preferred ratio of the second volume $V_2$ to the third volume $V_3$ would range from about 7:1 to about 12:1—including all ratios and sub-ranges there-between.

In another non-limiting example, a modular skate component 100 having a quarter pipe shape (such as modular skate component having the major surface 101*a* of FIG. 1) may have a third volume $V_3$ that is about 0.1% to about 5% of the first volume $V_1$—preferably about 0.5% to about 3% of the first volume $V_1$. In such non-limiting example, the modular skate component 100 may have a second volume $V_2$ that is about 95% to about 99.9% of the first volume $V_1$—preferably about 97% to about 99.5% of the first volume $V_1$. In such non-limiting example, the ratio of the second volume $V_2$ to the third volume $V_3$ would range from about 70:1 to about 100:1—including all ratios and sub-ranges there-between. In such non-limiting example, the preferred ratio of the second volume $V_2$ to the third volume $V_3$ would range from about 82:1 to about 92:1—including all ratios and sub-ranges there-between.

The combination of the body 150 formed from the first material having a first density and occupying the second volume V2 in combination with the outer layer 170 formed from the second material having a second density and occupying the third volume V3 may result in the modular skate component 100 having an overall density (also referred to as a "third density") that is less than the second density. According to some embodiments, the overall density of the modular skate component 100 may be less than the density of fresh water (i.e., non-salt water) under atmospheric conditions (i.e., 62.4 lb/ft$^3$), thereby allowing the modular skate component 100 to be buoyant in water—as discussed further herein. The overall density of the modular skate component 100 may also be less than the density of salt water.

Referring now to FIG. 7, the outer surface 121 of the core 120 may face the bottom surface 172 of the outer layer 170. The outer surface 121 of the core 120 may be in direct contact with the bottom surface 172 of the outer layer 170. In other embodiments, an intermediate layer may be positioned between the outer surface 121 of the core 120 and the bottom surface 172 of the outer layer 170. Additionally, the outer surface 151 of the body 150 may face the bottom surface 172 of the outer layer 170. The outer surface 151 of the body 150 may be in direct contact with the bottom surface 172 of the outer layer 170. In other embodiments, an intermediate layer may be positioned between the outer surface 151 of the body 150 and the bottom surface 172 of the outer layer 170.

The external surface 110 of the modular skate component 100 may comprise the top surface 171 of the outer layer 170. The major surface 101, 101*a*, 101*b* of the modular skate component 100 may comprise the top surface 171 of the outer layer 170. The side surface 103, of the modular skate component 100 may comprise the top surface 171 of the outer layer 170. The lower surface 102 of the modular skate component 100 may comprise the top surface 171 of the outer layer 170. The top support surface 104 of the modular skate component 100 may comprise the top surface 171 of the outer layer 170. Although not pictured, one or more additional top coating may be optionally applied to one or more of the external surfaces 110 of the modular skate component 100.

Figure 3:
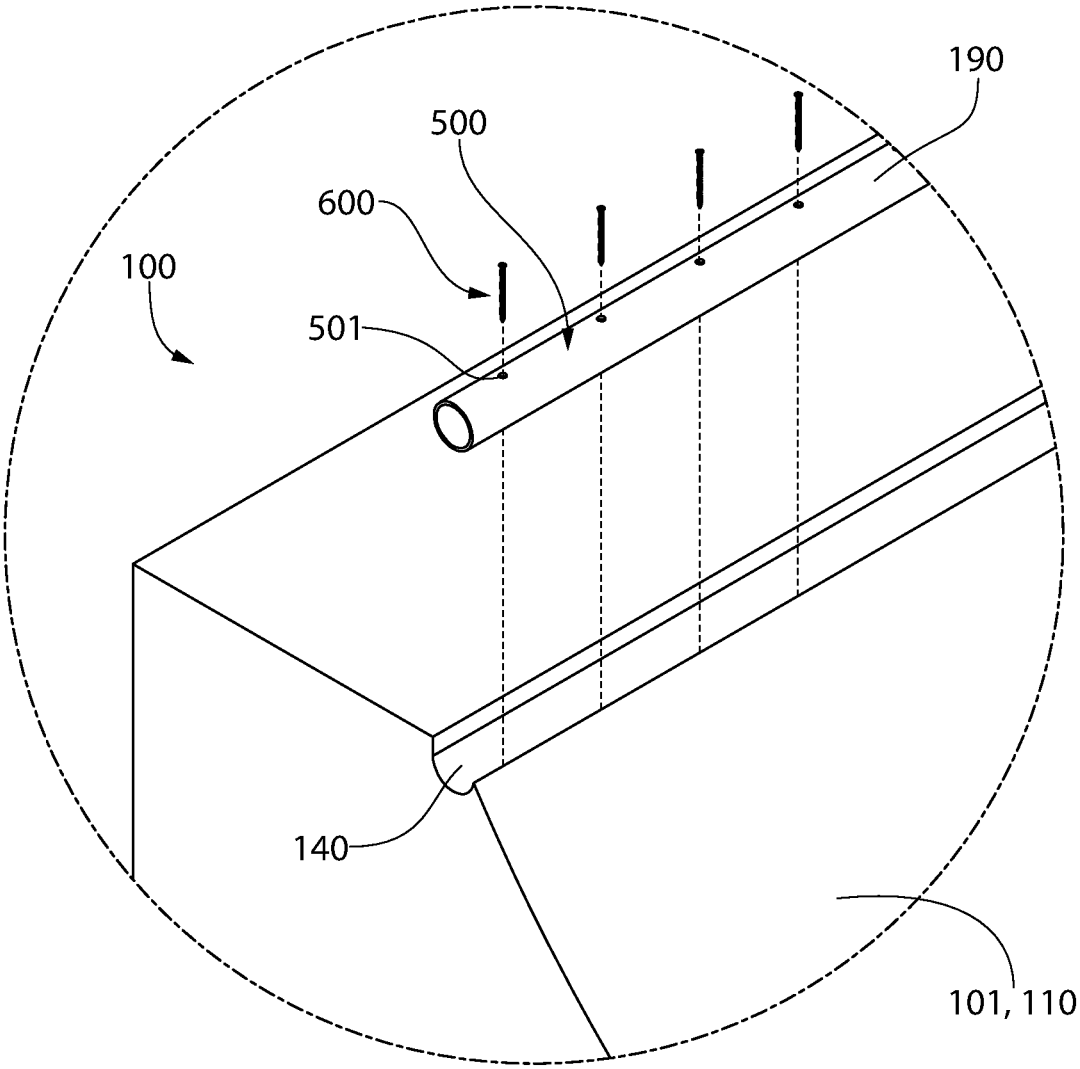
FIG. 3 is a close-up view of section III of FIG. 1.
Figure 4:
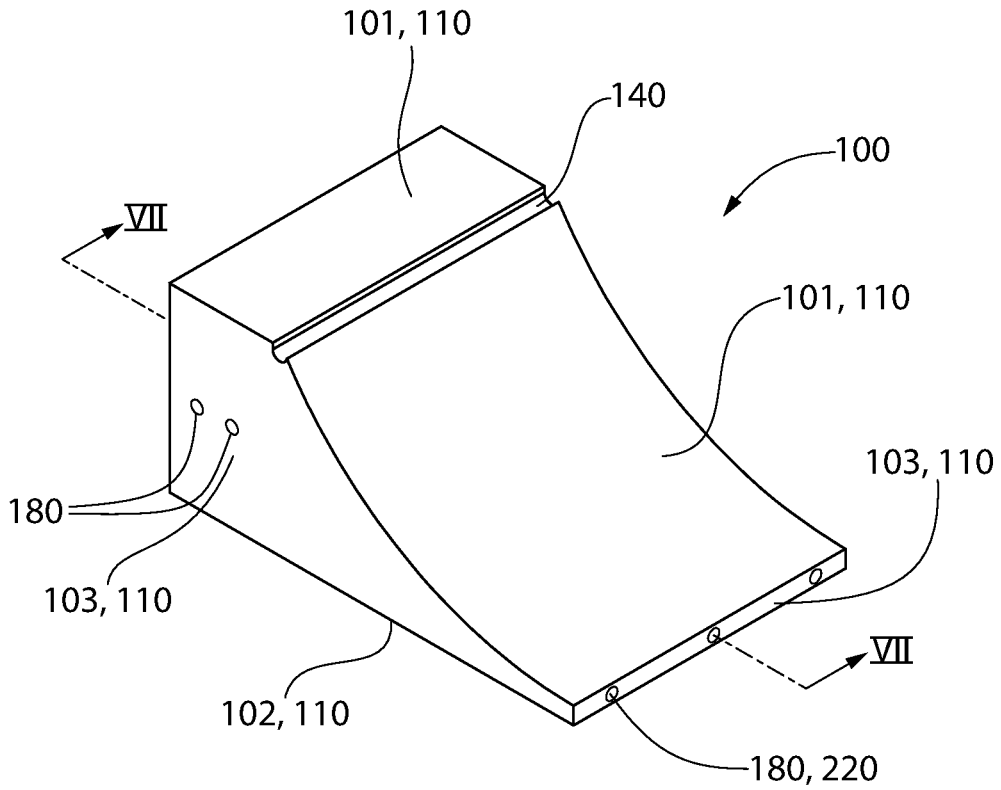
FIG. 4 is a top perspective view of a modular skate device according to an embodiment of the present invention.
Figure 12:
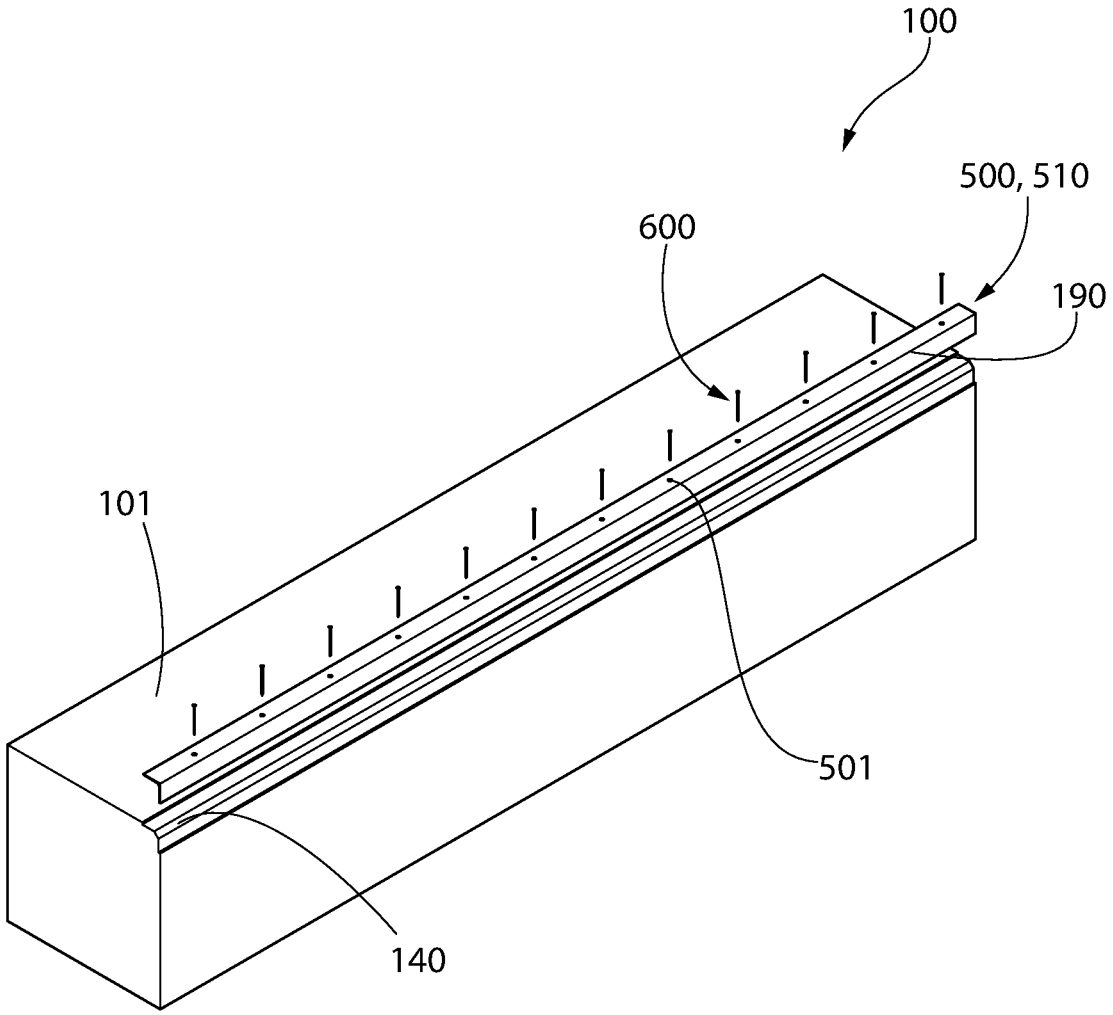
FIG. 12 is a top perspective view of a modular device according to another embodiment of the present invention.

Referring now to FIGS. 1, 3, and 12, each of the modular skate components 100 may further comprise an edge component 500. The edge component 500 may comprise an elongated body that extends along a longitudinal axis of the modular skate component 100. In other embodiments, the edge component 500 may comprise an elongated body that transverse to a longitudinal axis of the modular skate component 100.

As shown in FIGS. 1 and 3, the elongated body of the edge component 500 may be tubular. As shown in FIG. 12, other embodiments provide that the elongated body of the edge component 500 may be L-shaped. The edge component 500 may be formed from a third material. The edge component 500 may comprise a grind edge that may serve as a contact surface during use of the modular skate system 1.

The third material may be different from each of the first material and/or the second material. The third material may be metallic, ceramic, or a combination thereof. Non-limiting examples of the third material include steel, aluminum, concrete, marble, slate, and combinations thereof. The third material may have a third hardness—wherein the third hardness may be greater than each of the first hardness and the second hardness.

The edge component 500 may form part of the modular skate component 100 by being coupled to at least the outer layer 170 of the modular skate component 100. In some embodiments, the edge component 500 may form part of the modular skate component 100 by being coupled to the outer layer 170 and the core 120 of the modular skate component 100. The edge component 500 may be coupled to the outer layer 170 by an adhesive or by separate fastening hardware 600—as discussed in greater detail herein.

The adhesive may be a reactive adhesive. The term "reactive adhesive" refers to an adhesive that is provided as an uncured chemical composition. After being applied to at least one of the outer layer 170 and/or the edge component 500, the outer layer 170 and the edge component 500 are brought into contact and the chemical composition cures (i.e., chemically reacts) to adhesively bond the outer layer 170 to the edge component 500. Non-limiting examples of such chemical compositions include polyurethane, epoxy, acrylics, and the like. After curing, the cross-linked adhesive may be a thermoset polymer.

To help facilitate anchoring the edge component 500, the outer layer 170 and the core 120 may be shaped as to further comprise a receiving portion 140 configured to accept at least a portion of the edge component 500. The receiving portion 140 may be oriented such that the edge component 500 at least partially contacts a major surface 101 of the modular skate component 100. Under this configuration, the external surface 110 may further comprise the grind edge 190 that further enhances the skating experience when operating a skateboard on the modular skate component 100.

In some embodiments, edge component 500 may be attached by one or more edge coupling devices 600. Specifically, the edge coupling device 600 may anchor the edge component 500 to the multi-component structure comprising the outer layer 170 and the core 120. Non-limiting examples of coupling devices 600 include nails, screws, bolt, and the like. In some embodiments, the edge coupling device 600 may anchor the edge component 500 to the multi-component structure comprising the outer layer 170 and the core 120.

When the modular skate component 100 further comprises the edge component 500—the overall weight of the modular skate component 100 may still be light enough such that the modular skate component 100 remains buoyant when placed into a body of water—as discussed further.

As discussed further herein, the combination of the core 120 and the outer layer 170 that is used to create the multi-component structure of the present invention provides for custom tailoring of both size and shape of the resulting modular skate component 100 while still being able to maintain the requisite mechanical strength needed for that modular skate component 100 to function as a skate ramp or skate platform. Additionally, the combination of the core 120 and the outer layer 170 used to create the multi-component structure of the present invention allows each modular skate component 100 to be scaled to a wide variety of sizes—including large scales while still being able to maintain relatively low weight (compared to traditional poured concrete, which is traditionally used in the production of skate parks). By combining low weight, custom shaping, scalability, and high mechanical strength—each modular skate component 100 may be used alone or in combination with other modular skate components 100 to form a wide variety of modular skate systems 1, which are particularly useful in the formation of large skate park installations when cost and time concerns are limiting—as shown in FIGS. 13-16.

To install the modular skate system 1 of the present invention, each the modular skate component 100 may further comprise a connection system 200 that is used to attach together at least two modular skate components 100. The connection system 200 may comprise a plurality of attachment components 220. The attachment components 220 may comprise a first attachment component 180 that is positioned on one or more of the external surfaces 110 of the modular skate component 100. Specifically, the modular skate components 100 may comprise an attachment component 180 that is positioned on one or more of the side surfaces 103. The modular skate components 100 may comprise an attachment component 180 that is positioned on one or more of the lower surfaces 102 (not pictured). The modular skate components 100 may comprise an attachment component 180 that is positioned on one or more of the top support surfaces 104 (not pictured).

The first attachment component 180 may be a bore that extends inward from the external surface 110 toward the core 120 of the modular skate component 100. The term "bore" refers to an open cavity having a cavity floor and cavity walls that extend from the cavity floor to a cavity opening that is positioned on the external surface 110. According to the present invention, the term "bore" is not limited to a method of manufacture or a specific geometry (e.g., tubular, cube, cuboid).

The second attachment components 300 may be an entirely separate device comprising an attachment body comprising a sidewall 303 that extends along a longitudinal axis between a first end 301 and a second end 302—whereby the first end 301 is opposite the second end 302. The second attachment component 300 may be formed from a fourth material.

The fourth material may be different from each of the first material and/or the second material. The third material may be metallic, ceramic, or a combination thereof. Non-limiting examples of the third material include steel, aluminum, concrete, marble, slate, and combinations thereof.

The second attachment component 300 may be configured to cooperate with the first attachment component 180 of the modular skate components 100—thereby attaching together two adjacent the modular skate components 100—as discussed in greater detail herein. According to some embodiments, the first attachment component 180 may be considered to be a female connector and the second attachment component 300 may be considered to be a male adapter.

Referring now to FIGS. 7, 10, 11, and 17-19, in other embodiments, the first attachment component 180 may be a bore that extends inward from one of the external surfaces 110, through the entirety of the core 120 of the modular skate component 100 and to an opposite external surface 110. In such embodiments, the term "bore" may refers to an open-ended cavity defined by cavity walls that extend from a first open end to a second open end, whereby the first and second open ends are located on the external surfaces 110 of the modular skate component 100. As discussed, the term "bore" is not limited to a method of manufacture or a specific geometry (e.g., tubular, cube, cuboid).

In non-limiting embodiments, the side surfaces 103 may comprise a first side surface 103*a* that is positioned opposite from a second side surface 103*b* on the modular skate component 100. The first side surface 103*a* may be a mirror of the second side surface 103*b*. In other embodiments, the first side surface 103*a* may have a different configuration than the second side surface 103*b*—the term "different configuration" may refer to different surface area, different height, different width, and/or different surface topography.

The first attachment component 180 may be present on both the first and second side surfaces 103*a*, 103*b*. In particular, the first attachment component 180 may be a bore that comprises a first open end located on the first side surface 103*a* and a second open end located on the second side surface 103*b*, as well as a continuous cavity defined by walls that extend uninterrupted from the first open end on the first side surface 103*a* to the second open end on the second side surface 103*b*. The walls defining the continuous cavity of the first attachment component 180 may extend (1) from the top surface 171 to the bottom surface 172 of the outer layer 170 located adjacent to the first side surface 103*a*, (2)

through the entirety of core 120, and (3) from the bottom surface 172 to the top surface 171 of the outer layer 170 located adjacent to the second side surface 103*b*. The result is the first attachment component being a bore that extends continuously from the first side surface 103*a* to the second side surface 103*b*.

The bore may be formed by inserting a hot-wire through one or more surfaces of the core 120 (before application of the outer layer 180) to cut a remove volume of the core that equals the volume of the resulting cavity formed in the core 120. The remove volume is then removed from the core 120 to form the open cavity. The hot-wire may comprise a heated metallic, ceramic, or composite wire that is heated to a temperature ranging from about 400° F. to about 800° F.—including all temperatures and sub-ranges there-between.

Referring now to FIGS. 1, 2, 16, and 17, the modular skate system 1 of the present invention comprises at least a first modular skate component 100*a* and a second modular skate component 100*b* and a connection system 200 that includes a plurality of attachment components 220 used to couple together the first modular skate component 100*a* and the second modular skate component 100*b*. The plurality of attachment components 220 may comprise at least one of a first attachment component 180 and at least one of a second attachment component 300. Stated otherwise, the modular skate system 1 of the present invention may comprise at least a first modular skate component 100*a*, a second modular skate component 100*b*, a first attachment component 180, and a second attachment component 300.

Each of the modular skate components 100, 100*a*, 100*b* may comprise at least one of the first attachment components 180—the first attachment components 180 being the bores formed in the side surface 103, bottom surface 102, and/or top support surface 104 of the modular skate components 100, 100*a*, 100*b*.

The second attachment component 300 may be configured to cooperate with the first attachment component 180 of the modular skate components 100, 100*a*, 100*b*. The first attachment component 180 may be considered to be a female connector and the second attachment component 300 may be considered to be a male adapter. The second attachment component 180 is configured to slidingly engage the first attachment components 180 of each the first modular skate component 100*a* and the second modular skate component 100*b*, thereby coupling the first modular skate component 100*a* to the second modular skate component 100*b*.

Specifically, the modular skate system 1 of the present invention may be installed by providing the first modular skate component 100*a*, the second modular skate component 100*b*—each of which comprise the first attachment component 180—as well as provide the second attachment component 300. Next, the second attachment component 300 may slidingly engage the first attachment components 180 of the first and second modular skate components 100*a*, 100*b*. Subsequently, the first modular skate component 100*a* and the second modular skate component 100*b* are brought together such that the corresponding side surfaces 103*a*, 103*b* are in close proximity to each other—i.e., at least a portion of each side surfaces 103*a*, 103*b* are in direct contact with each other (as show in FIG. 17).

Figure 17:
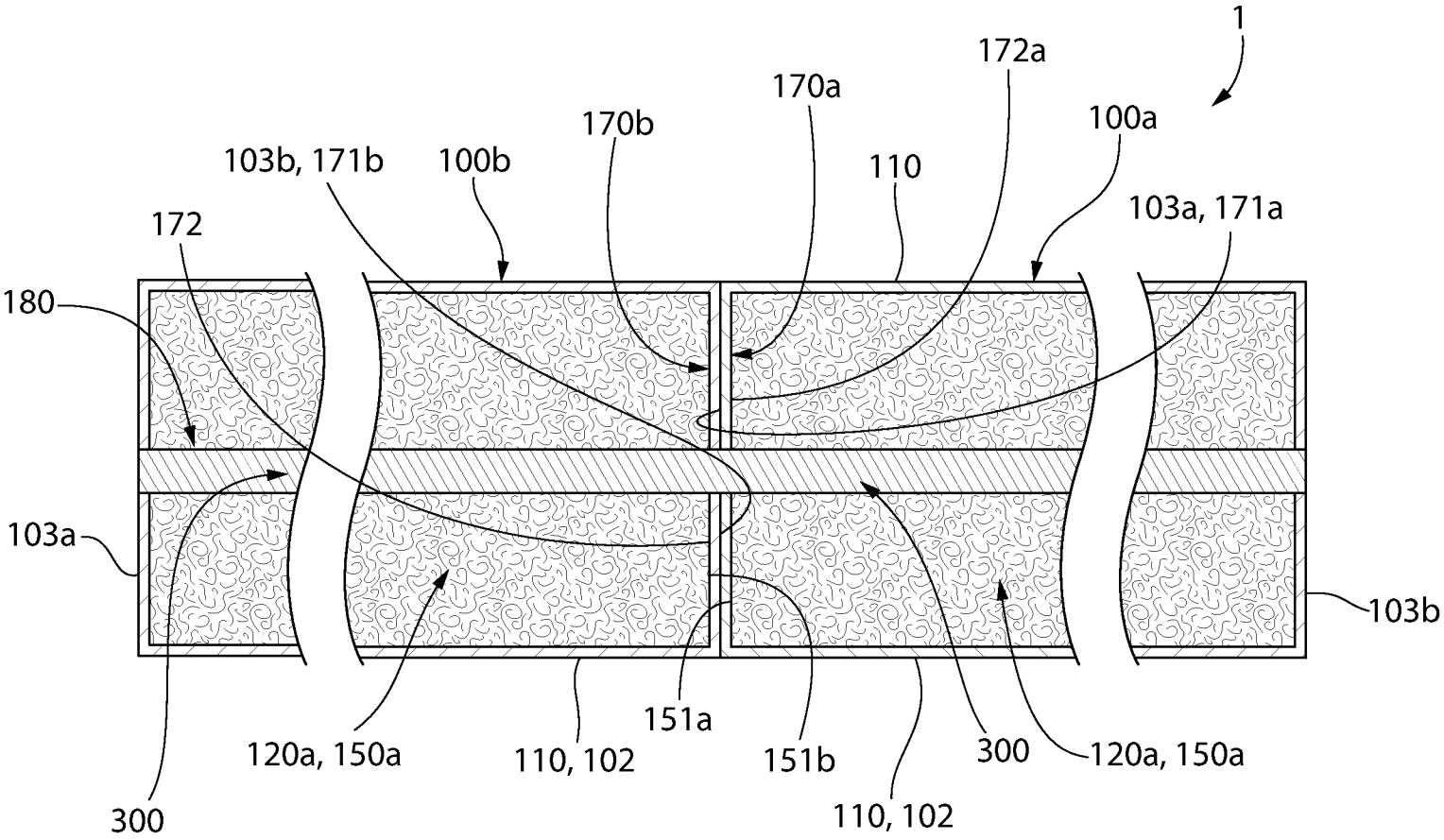
FIG. 17 is a cross-sectional view of the modular skate system according to lines XVII-XVII in FIG. 16.
Figure 18:
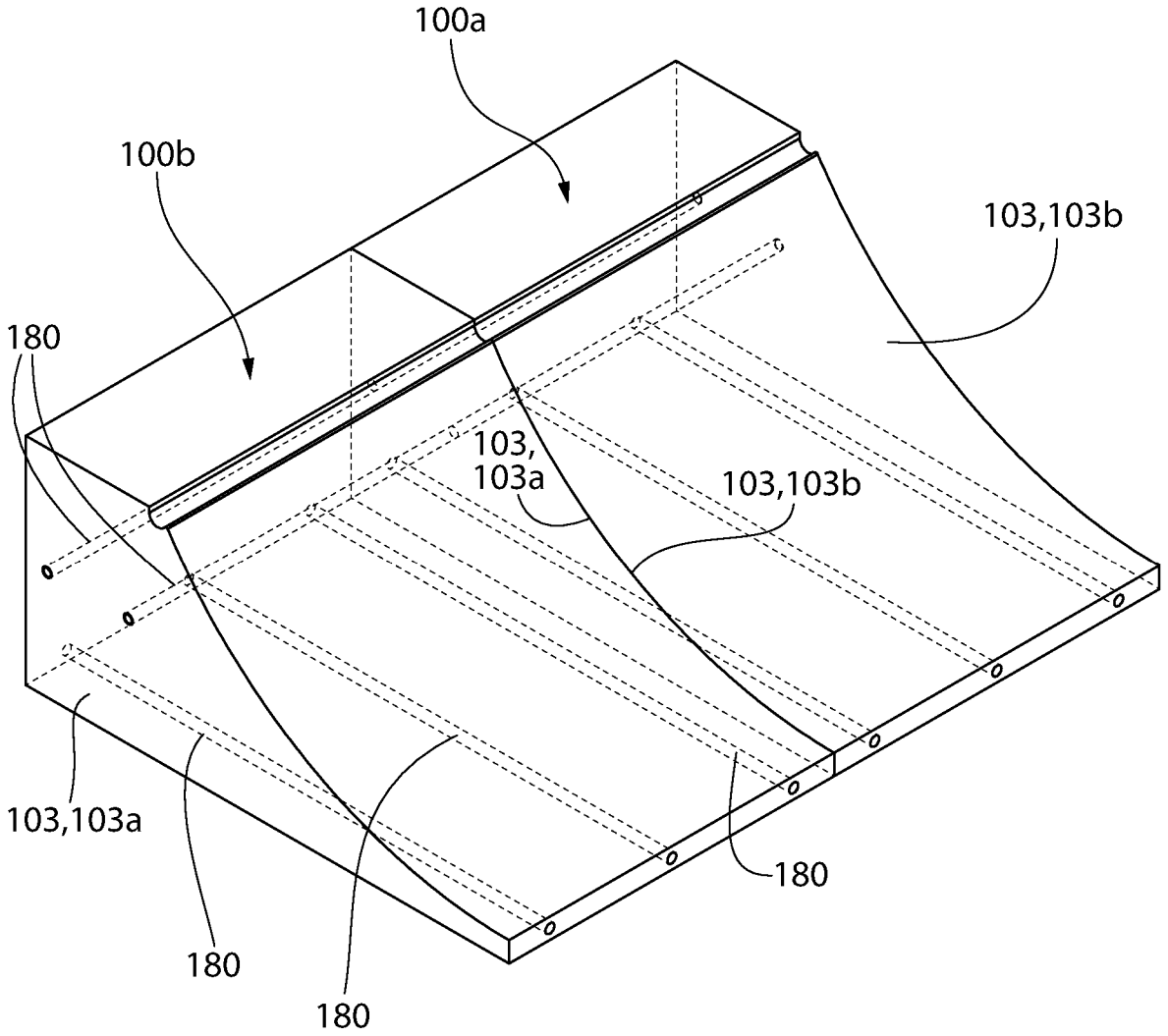
FIG. 18 is a semi-transparent perspective view of a modular system according to an embodiment of the present invention.
Figure 19:
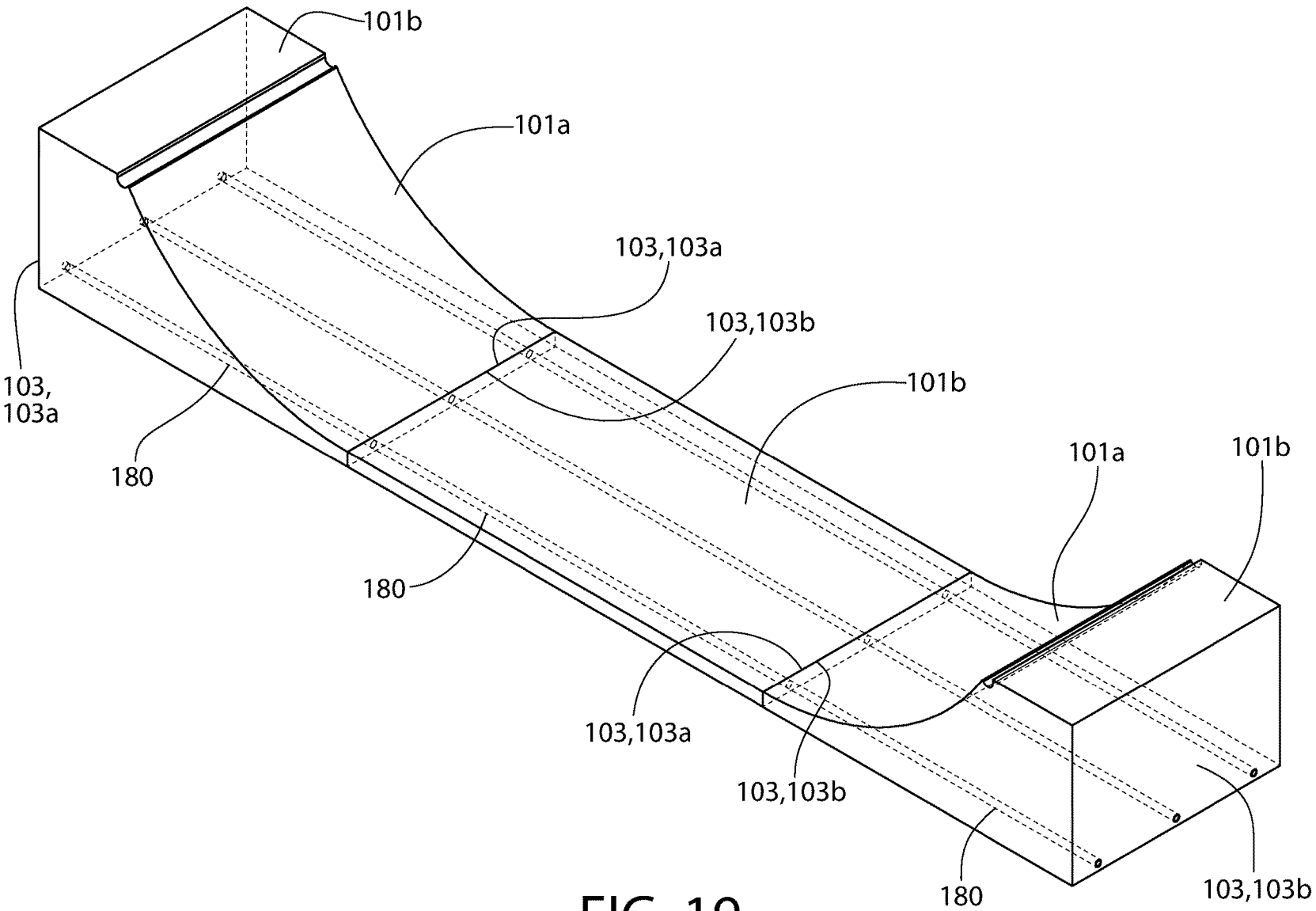
FIG. 19 is a semi-transparent perspective view of a modular system according to an embodiment of the present invention.

Referring now to FIGS. 17-19, in the installed state the second attachment component 300 extends past both the outer layer 170*a*, 170*b* of both the first modular skate component 100*a* and the second modular skate component 100*b*. The sidewall 303 of the second attachment component 300 may contact at least a portion of both the outer layers 170*a*, 170*b* for both the first modular skate component 100*a* and the second modular skate component 100*b*. Additionally, the second attachment component 300 extends into both the first body 120*a* of the first modular skate component 100*a* and the second body 120*b* of the second modular component 100*b*. The sidewall 303 of the second attachment component 300 may contact at least a portion of both the first body 120*a* and the second body 120*b*. The first end 301 of the second attachment component 300 may be surrounded by the first body 120*a* and the second end 302 may be surrounded by the second body 120*b*. Alternatively, the second end 302 of the second attachment component 300 may be surrounded by the first body 120*a* and the first end 301 of the second attachment component 300 may be surrounded by the second body 120*b*.

Referring again to FIG. 17, the present invention further includes a skate component attachment apparatus comprising the first foam body 120*a*, a first polymeric layer, 170*a*, the second polymeric layer 170*b*, a second foam body 120*b*, and the attachment component 300. According to such embodiments, the first end 301 of the attachment component 300 is surrounded by the first foam body 120, the second end 302 of the attachment component 300 is surrounded by the second foam body 120*b*, and at least a portion of the attachment body extends through both the first polymeric layer 170*a* and the second polymeric layer 170*b*. Additionally, the first body 120*a* is separated by the second body 120*b* by at least one of the first polymeric layer 170*a* and/or second polymeric layer 170*b*.

Once installed, each of the major surfaces 101 of the first modular skate component 100*a* and the second modular skate component 100*b* form a substantially continuous skate surface. Stated otherwise, the resulting modular skate park that may be formed using the modular skate system 1 of the present invention may comprise a skate surface that is used to move and perform tricks, whereby the skate surface comprises at least the major surfaces 101 of the first modular skate component 100*a* and the second modular skate component 100*b*. The major surface 101 of the first modular skate component 100*a* may be co-planar with the major surface 101 of the second modular skate component 100*b*.

Each of the modular skate components 100 may be formed according to a methodology described herein. The method comprises providing a block of the first material. The block may have a pre-determined shape, thereby forming the body 150 of the present invention. In other embodiments, the block may be shaped into a specific configuration that meets the desired geometry of the body 150—thereby forming the core 120. Non-limiting examples of shaping the block include cutting the block with a cutting tool—such as a heated wire element (i.e., "hot-wire"), shaving portions off with a shaving tool, or combinations thereof. In other embodiments, the body 150 may be formed by injection molding a reactive composition into a shaped mold, whereby the reactive composition cures and form a shaped cellular body that is the body 150 of the present invention.

According to some embodiments, one or more coatings of an intermediate composition may optionally be applied to the outer surface 151 of the body 150—either in the form of a coating or intermediate layer—to form the core 120.

Subsequently, the reactive composition that forms the second material may be applied to the outer surface 121 of the core 120. Non-limiting examples of application include spray coating, dip-coating, and roll-coating the reactive composition to the outer surface 121 of the core 120. The reactive composition may be applied to the core 120 such that the core 120 is entirely encapsulated. Alternatively, the reactive composition may be applied to the core 120 such that at least a portion of the outer surface 121 of the core 120 remains uncoated by the reactive composition. Once applied, the reactive composition is allowed to cure, thereby forming the second material.

Once cured, one or more attachment components 220 may be added. In non-limiting embodiments, the attachment component 220 may be formed by machining the side surface 103 (or the bottom surface 102 and/or the top support surface 104) of the modular skate component 100 with a tool to form the bore 180 that extends from the side surface 103 into the core 120. Specifically, the bore may extend from the side surface 103, through the outer layer 170, and into the core 120. Stated otherwise, the cavity walls that form the bore 180 may be formed at least partially by the outer layer 170 and at least partially by the core 120, whereby the cavity floor is formed by the core 120.

Figure 20:
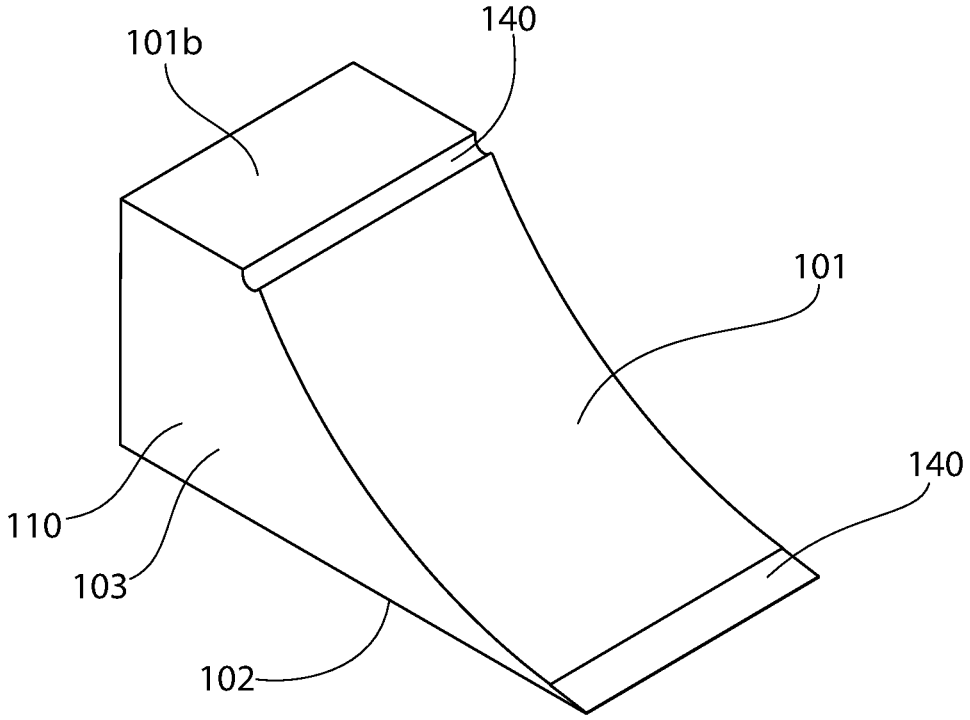
FIG. 20 is a perspective view of a modular skate device according to an embodiment of the present invention.
Figure 21:
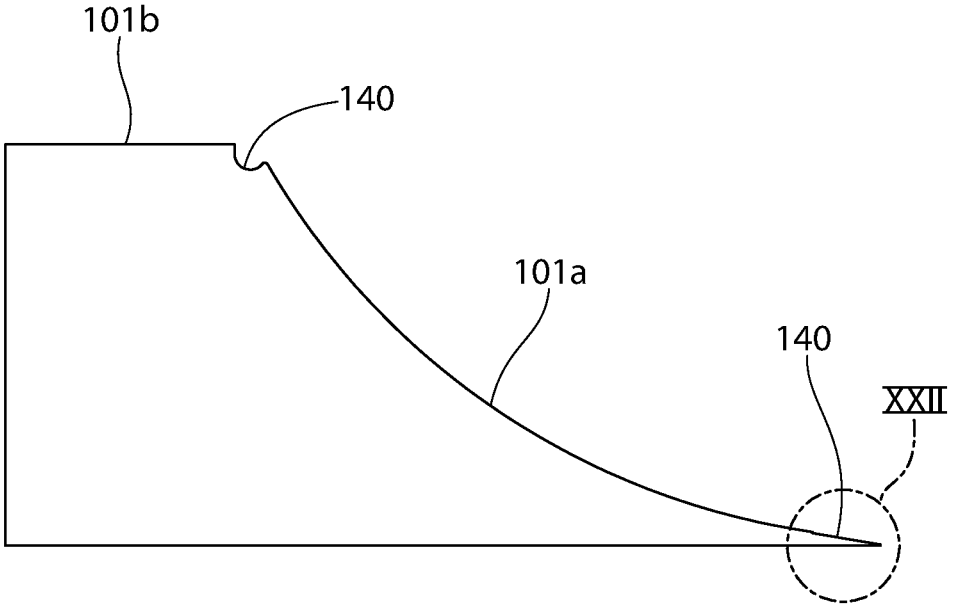
FIG. 21 is a side view of the modular skate device of FIG. 20.
Figure 22:
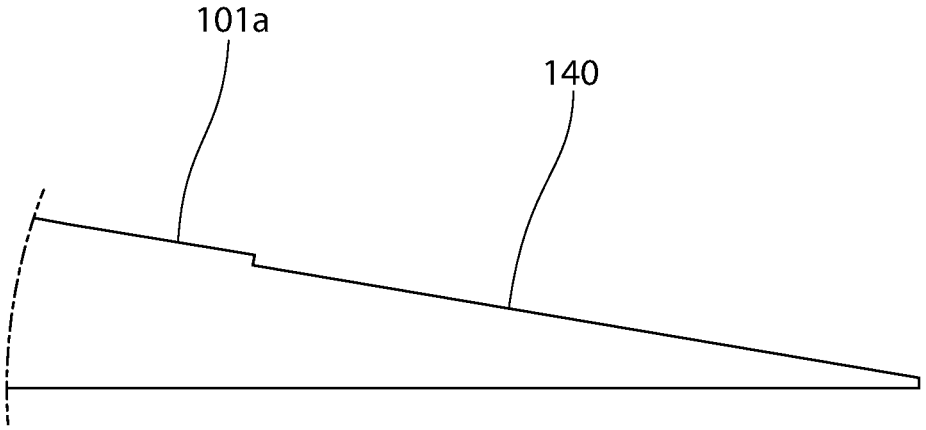
FIG. 22 is a close-up view of the modular skate device in section XXII of FIG. 21.
Figure 23:
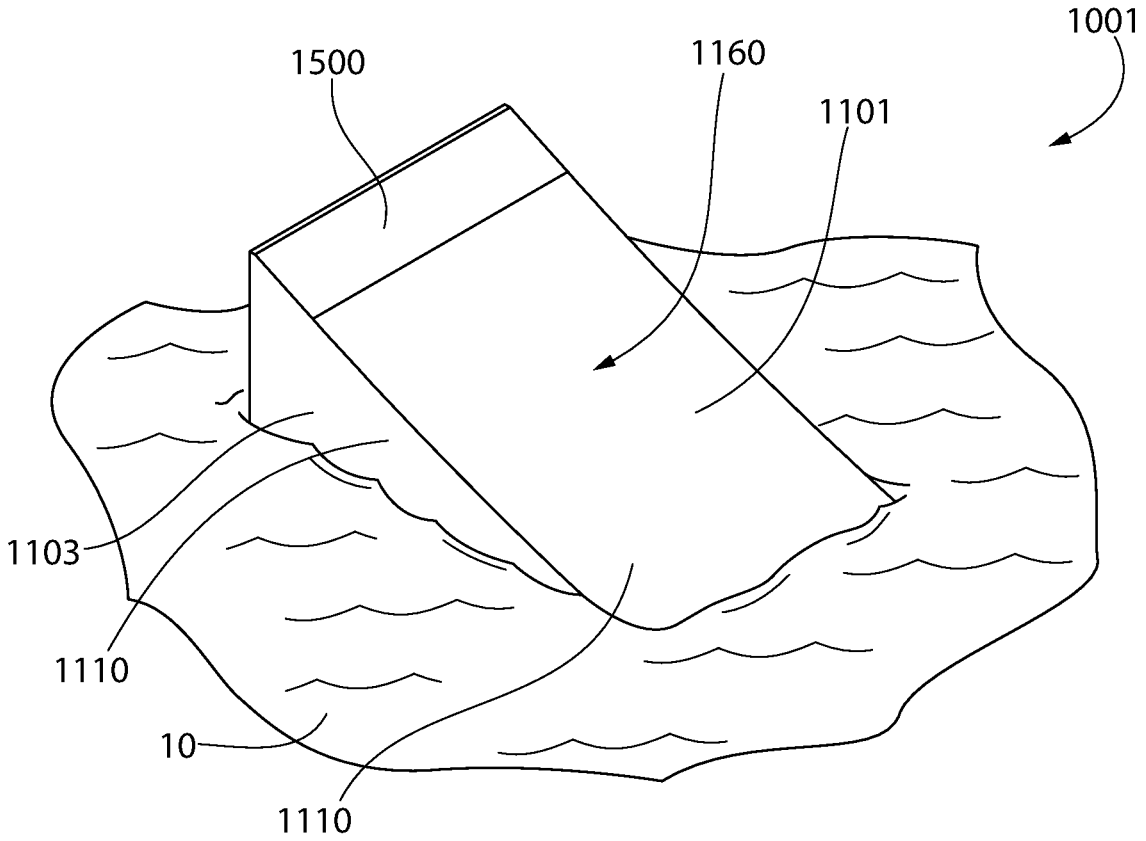
FIG. 23 is a perspective view of a water sport system comprising a water sport device according to another embodiment of the present invention.
Figure 24:
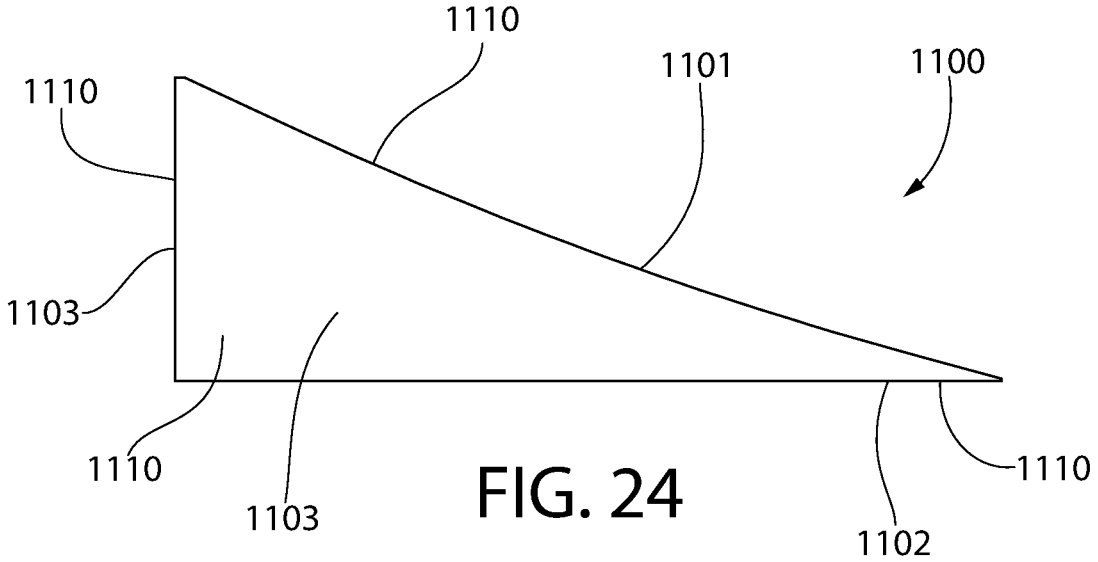
FIG. 24 is a side view of the water sport device of FIG. 23.

Referring now to FIGS. 20-22, the modular skate components 100 may also be formed as a singular component without the connection system 200. In such embodiments, the outer layer 170 may fully encapsulate the core 120. In such embodiments, the outer layer 170 may form a continuous water impervious barrier to the core 120. In such embodiments, the modular skate component 100 may comprise one or more receiving portions 140 suitable for attachment of an edge component 500. In the exemplified embodiment, the modular skate component 100 comprises two receiving portions 140 and two corresponding edge components 500, whereby a first edge component 500 is located adjacent to the top surface 104 of the modular skate component 100 and the second edge component 500 is located adjacent to the bottom surface 102 of the modular skate component.

Referring now to FIGS. 23-27, a modular sport ramp 1100 suitable for water-sports is illustrated in accordance with another embodiment of the present invention. The water-sport component 1100 is similar to the modular skate component 100 except as described herein below. The description of the modular skate component 100 above generally applies to the water-sport component 1100 described below except with regard to the differences specifically noted below. A similar numbering scheme will be used for the water-sport 1100 as with the modular skate component 100 except that the 1000-series of numbers will be used.

The outer layer of the water-sport component 1100 may fully encapsulate the core to form a continuous water impervious barrier to the core 120. Similar to as discussed with respect to the modular skate component 100, the materials and relative volumes of the outer layer and the core may be selected such that the resulting water-sport component has a density that is less than water. In such embodiments, the water-sport component 1100 will be buoyant when placed into an aquatic environment 10 (e.g., a lake, the ocean, a pool, etc.). Thus, a water-sport system 1 may be formed by placing the water-sport component 1100 of the present invention into an aquatic environment.

In such embodiments, the major surface 1101 of the water-sport component 1100 may be suitable as a contact surface for wake boards, water skis, jet skis, inner-tubing, and the like. In such embodiments, the side surface 1103 of the water-sport component 1000 may be partially submerged in the aquatic environment 10. In such embodiments, the bottom surface 1102 of the water-sport component 1000 may be fully submerged in the aquatic environment 10.

Figure 25:
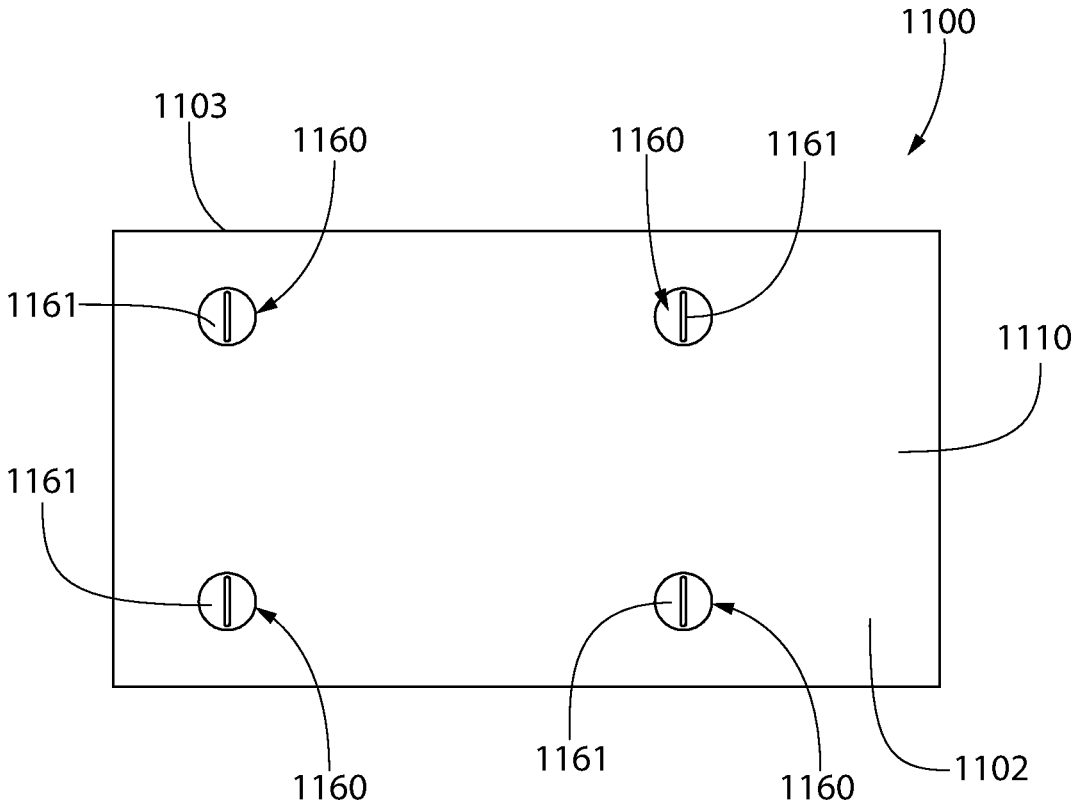
FIG. 25 is a bottom view of the water sport device of FIG. 23.
Figure 26:
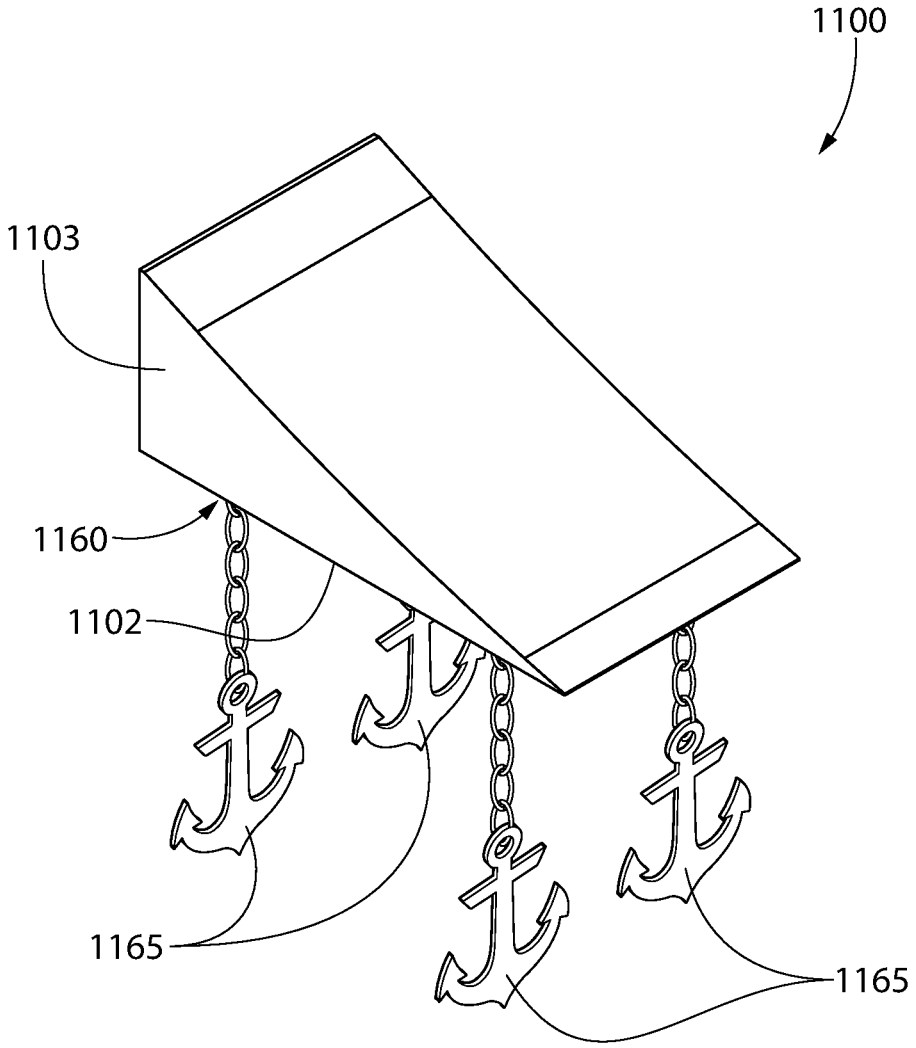
FIG. 26 is a perspective view of a water sport assembly that comprises the water sport device of FIG. 23.
Figure 27:
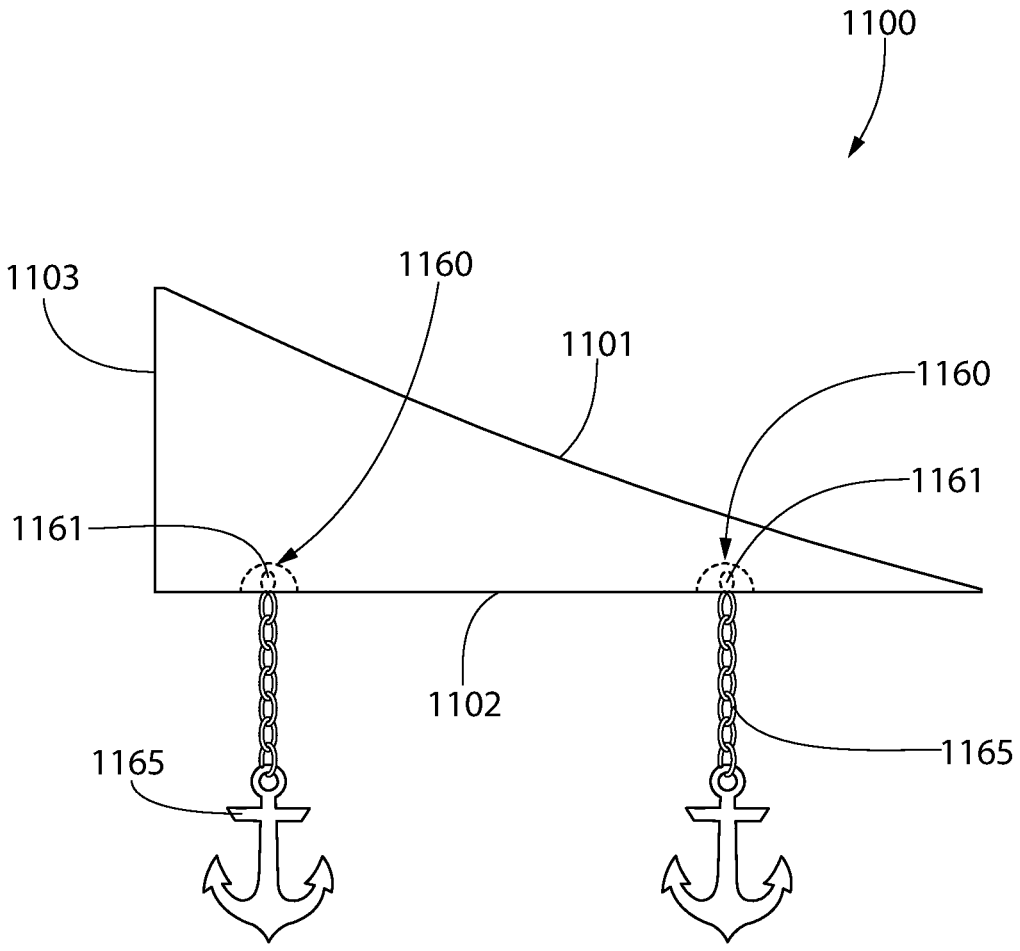
FIG. 27 is a side view of the water sport assembly of FIG. 26.

Referring now to FIGS. 25-27, the water-sport component 1100 may further comprise connection apparatus 1160 that may be configured to attach to an anchor 1165. The term "anchor" refers to a weighted body or device having at least one attachment means. The weighted body may be of any shape or size and is not limited to what is shown in the Figures.

The connection apparatus 1160 may comprise a connection hardware 1161 that is particularly suitable for attachment of the anchor 1165 to the water-sport component 1100. Examples of the connection hardware 1161 include, but are not limited to, rods, closed-loops, clasps, clevis links, bolts, and the like. The connection hardware 1161 may either be (1) configured to be attached direct to the attachment means of the anchor 1165 or (2) configured to be attached to an intermediate hardware, such as a chain, rope, wire, or the like, that connects the connection hardware to the attachment means of the anchor.

Once the anchor is attached to the water-sport component 1100, the water-sport component 1100 may be placed into an aquatic environment 10, whereby the anchors 1165 at least partially counteract the buoyancy force of the water-sport component 1100 to prevent the water-sport component 1100 from floating away from its desired position within the aquatic environment.

As demonstrated by FIGS. 25 and 27, the connection apparatus 1160 may be positioned on the bottom surface 1102 of the water-sport component 1100. Specifically, the connection hardware 1161 are formed into the bottom surface 1102 of the water-sport component 1100. In such embodiments, the anchors 1165 will be located directly beneath the lower surface 1102 of the water-sport component 1100.

Figure 28:
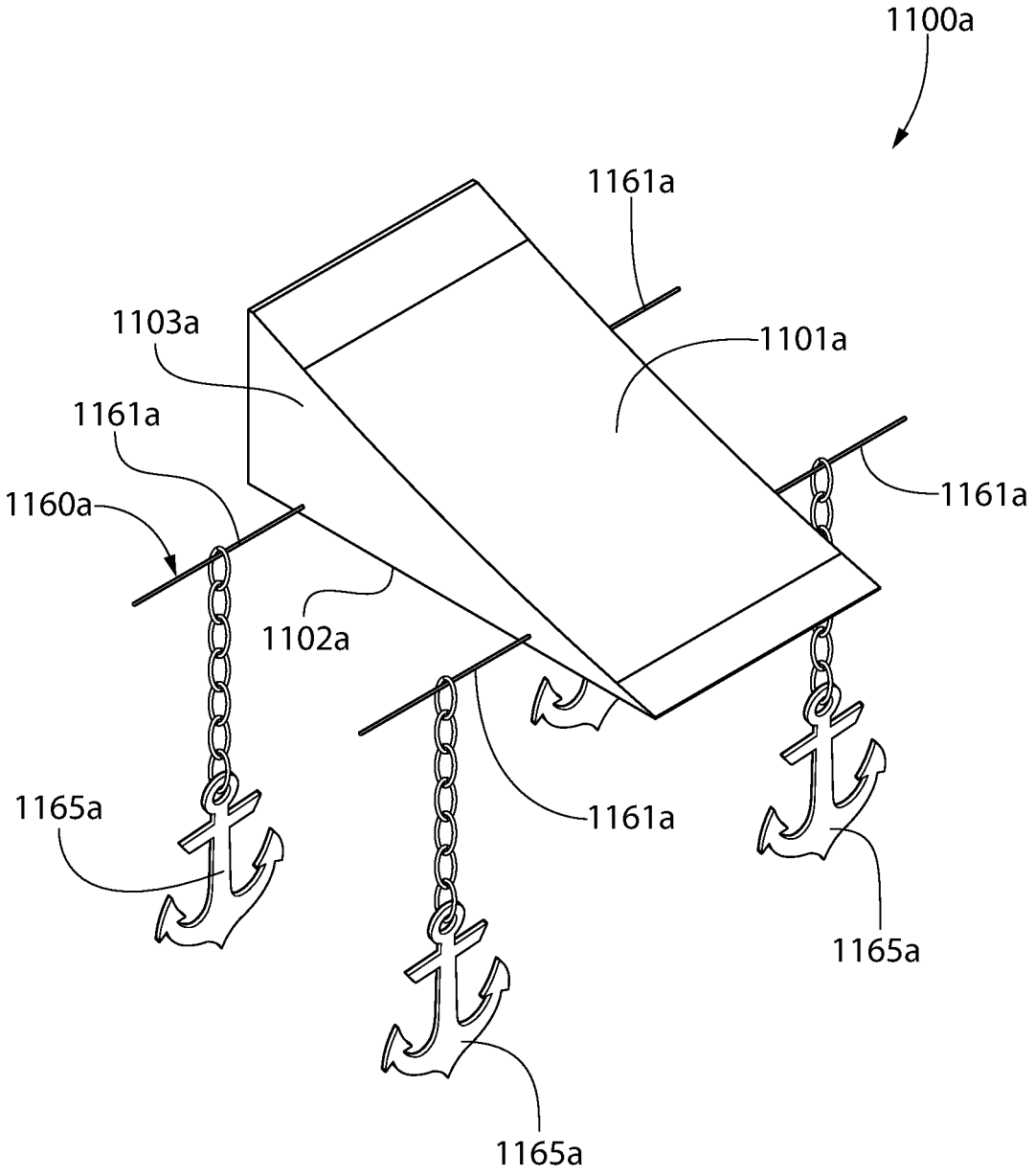
FIG. 28 is a perspective view of a water sport assembly according to another embodiment of the present invention.
Figure 29:
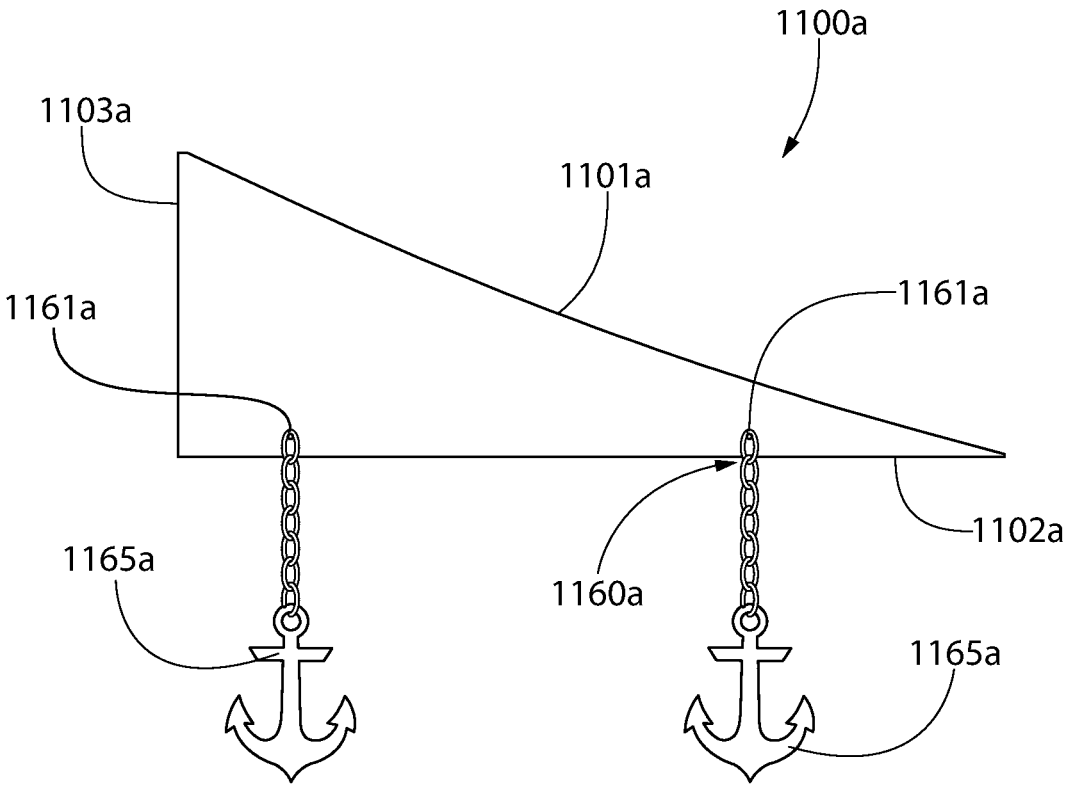
FIG. 29 is a side view of the water sport assembly of FIG. 28.

Referring now to FIGS. 28 and 29, in an alternative embodiment, the connection apparatus **1160*a* may extend from the side surfaces 1103*a* of the water-sport component 1100*a*. Specifically, the connection hardware 1161*a* may extend from the side surfaces 1103*a* of the water-sport component 1100*a*. In such embodiments, the anchors 1165*a* will be horizontally offset away from the side surfaces 1103*a* of the water sport component 1100*a* such that the anchors 1165 are not located directly beneath the lower surface 1102*a* of the water-sport component 1100*a***.

The water-sport component 1100 may have a major surface 1101 with a layer thickness $T_L$ that ranges from about 220 mils to about 280 mils—including all thickness and sub-ranges there-between. According to a preferred embodiment, the water-sport component 1100 may have a major surface 1101 with a layer thickness $T_L$ that ranges from about 235 mils to about 265 mils—including all thickness and sub-ranges there-between.

The water-sport component 1100 may have a lower surface 1102 with a layer thickness $T_L$ that ranges from about 170 mils to about 230 mils—including all thicknesses and sub-ranges there-between. According to a preferred embodiment, water-sport component 1100 may have a lower surface 1102 with a layer thickness $T_L$ that ranges from about 185 mils to about 215 mils—including all thicknesses and sub-ranges there-between. The layer thickness $T_L$ of the lower surface 1102 may be less than the layer thickness $T_L$ of the major surface 1101.

The water-sport component 1100 may have a side surface 1103 with a layer thickness $T_L$ that ranges from about 170 mils to about 230 mils—including all thicknesses and sub-ranges there-between. According to a preferred embodiment, the water-sport component 1100 may have a side surface 1103 with a layer thickness $T_L$ that ranges from about 185 mils to about 215 mils—including all thicknesses and sub-ranges there-between. The layer thickness $T_L$ of the side surface 1103 may be less than the layer thickness $T_L$ of the major surface 1101.

The water-sport component 1100 may have a ratio of the layer thickness $T_L$ for the major surface 1101 and the layer thickness $T_L$ of the lower surface 1102 that ranges from about 1.1:1 to about 4:1—including all ratios and sub-ranges there-between. In a preferred embodiment, the water-sport component 1100 may have a ratio of the layer thickness $T_L$ for the major surface 1101 and the layer thickness $T_L$ of the lower surface 1102 that ranges from about 1.1:1 to about 2:1—including all ratios and sub-ranges there-between.

The water-sport component 1100 may have a ratio of the layer thickness $T_L$ of the major surface 1101 and the layer thickness $T_L$ of the side surface 1103 that ranges from about 1.1:1 to about 4:1—including all ratios and sub-ranges there-between. In a preferred embodiment, the water-sport component 1100 may have a ratio of the layer thickness $T_L$ of the major surface 1101 and the layer thickness $T_L$ of the side surface 1103 that ranges from about 1.1:1 to about 2:1—including all ratios and sub-ranges there-between.

Figure 30:
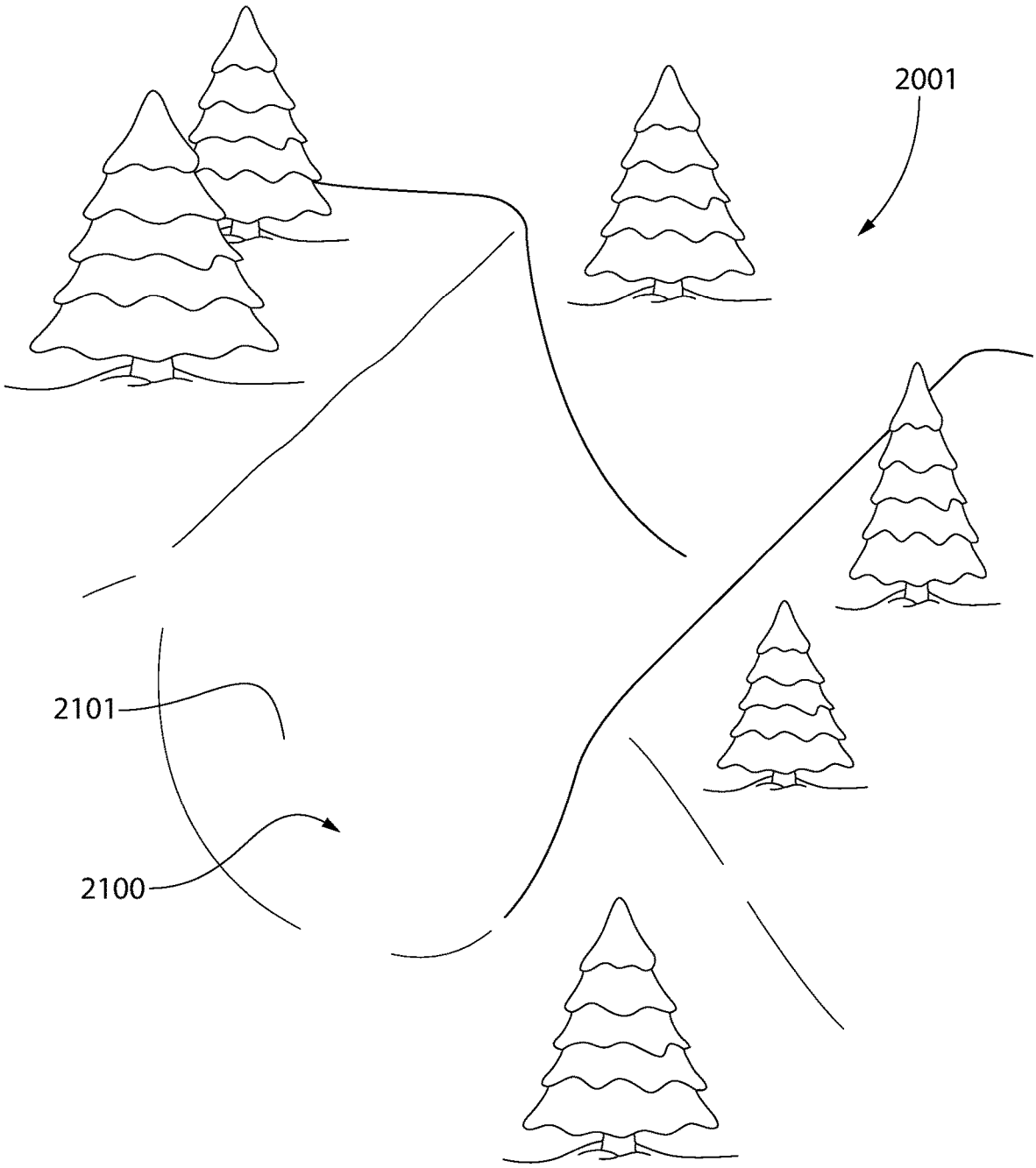
FIG. 30 is a perspective view of a snow sport system comprising the skate device of the present invention.

Referring now to FIG. 30, a modular sport ramp 2100 suitable for snow-sports is illustrated in accordance with another embodiment of the present invention. The snow-sport component 2100 is similar to the modular skate component 100 and the water-sport component 1100 except as described herein below. The description of the modular skate component 100 above generally applies to the snow-sport component 2100. A similar numbering scheme will be used for the snow-sport 2100 as with the modular skate component 100 and the water-sport component 1100 except that the 2000-series of numbers will be used.

In some embodiments, the present invention includes a snow-sport course 2000 comprising a snow-sport component 2100 comprising an outer layer and core—as previously discussed. The outer layer may comprise a major surface 2101 that is suitable for contact with skis, snow boards, and the like. Although not pictured in FIG. 30, the snow-sport component may comprise the connection system as described with respect to the modular skate component 100. Additionally, the aforementioned layer thickness $T_L$ ranges and ratios as applied to the water-sport component 1100 also applies to the snow-sport component 2100.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A sport ramp apparatus comprising:

a foam body; and a polymeric layer surrounding the foam body;

wherein the water-sport ramp comprises a major surface, side surfaces, and a bottom surface, whereby the major surface has a first thickness and the side and bottom surfaces have a second thickness, the first thickness being greater than the second thickness, and the water-sport ramp apparatus has an overall density that is less than 63 lb/ft$^3$;

wherein at least one recess is formed into the bottom surface of the water-sport ramp, the recess defining an open-ended cavity that is surrounded by a recess wall, the recess wall formed by the polymeric layer, and wherein an attachment hardware configured for attachment to a weighted device is located within the open-ended cavity, the attachment hardware selected from one or more of a rod, a closed-loop, a clasp, a bolt, and a clevis link.

2. The water-sport ramp apparatus of claim 1, wherein the polymeric layer forms a water-impervious barrier to the foam body.

3. The water-sport ramp apparatus of claim 1, wherein the water-sport ramp further comprises a weighted device that is coupled to the attachment hardware and extends beneath the bottom surface of the sport ramp apparatus.

4. The water-sport ramp apparatus of claim 1, wherein the foam body has a first hardness and the polymeric layer has a second hardness, wherein the first hardness is different from the second hardness.

5. The water-sport ramp apparatus of claim 1, wherein the foam body has a first density and the polymeric layer has a second density, wherein the first density is less than the second density.

6. The water-sport ramp apparatus of claim 5, wherein the first density is a bulk density ranging from about 0.8 lb/ft$^3$ to about 3.0 lb/ft$^3$.

7. The water-sport ramp apparatus of claim 5, wherein the second density is a bulk density ranging from about 45 lb/ft$^3$ to about 57 lb/ft$^3$.

8. The water-sport ramp apparatus of claim 1, wherein foam body has a first volume and the polymeric layer has a second volume, and wherein the ratio of the first volume to second volume ranges from about 5:1 to about 200:1.

9. The water-sport ramp apparatus of claim 1, wherein the major surface is planar.

10. The water-sport ramp apparatus of claim 1, wherein the major surface is curved.

11. A modular water-sport ramp apparatus comprising:

an exposed outer surface comprising a major surface opposite a lower surface, a first side surface opposite a second side surface, the first and second side surfaces intersecting the major surface;

a core comprising:

a foam body formed from a first polymeric material, the foam body having a lower surface;

at least one open-ended cavity extending through the foam body, the open-ended cavity having cavity walls that extend between a first open end that is opposite a second open end;

an outer layer formed from a second polymeric material, the second polymeric material being different from the first polymeric material, and wherein the outer layer at least partially surrounds the core such that the major surface, lower surface, the first side surface, and the second side surface comprises the outer layer; and wherein the open-ended cavity extends continuously from the first side surface of the modular water-sport ramp apparatus to the second side surface of the modular water-sport ramp apparatus such that the first open end is located on the first side surface and the second open end is located on the second side surface; and wherein the cavity walls of the open-ended cavity are inset from the lower surface of the foam body, and the cavity walls of the least one open-ended cavity form a tube that extends continuously from the first side surface to the second side surface through the foam body.

12. The modular water-sport ramp apparatus according to claim 11, wherein the first polymeric material has a density ranging from about 0.8 $lb/ft^3$ to about 3.0 $lb/ft^3$ and the second polymeric material has a density of at least 30 $lb/ft^3$.

13. The modular water-sport ramp apparatus according to claim 11, wherein the outer layer forms a water-impervious barrier extending between the major surface and the foam core.

14. The modular water-sport ramp apparatus according to claim 11, wherein the modular water-sport ramp apparatus has a first volume, the core has a second volume, and the outer layer has a third volume, wherein the third volume ranges from about 0.1% to about 15.0% of the first volume and the second volume ranges from about 85.0% to about 99.5% of the first volume.

15. The modular water-sport ramp apparatus skate component according to claim 11, wherein the modular water-sport ramp apparatus has a first volume, the core has a second volume, and the outer layer has a third volume, wherein the ratio of the second volume to third volume ranges from about 5:1 to about 200:1.

16. The modular water-sport ramp apparatus according to claim 11, further comprising an elongated body at least in partial contact with the major surface, the elongated body formed from a metallic material.

* * * * *